US010655917B2

(12) United States Patent
Inoue et al.

(10) Patent No.: US 10,655,917 B2
(45) Date of Patent: May 19, 2020

(54) HEAT EXCHANGER AND AIR CONDITIONING DEVICE

(71) Applicant: DAIKIN INDUSTRIES, LTD., Osaka-shi, Osaka (JP)

(72) Inventors: Satoshi Inoue, Sakai (JP); Hirokazu Fujino, Sakai (JP); Masanori Jindou, Sakai (JP); Kousuke Morimoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 216 days.

(21) Appl. No.: 15/025,517

(22) PCT Filed: Jul. 10, 2014

(86) PCT No.: PCT/JP2014/068464
§ 371 (c)(1),
(2) Date: Mar. 28, 2016

(87) PCT Pub. No.: WO2015/045564
PCT Pub. Date: Apr. 2, 2015

(65) Prior Publication Data

US 2016/0238322 A1 Aug. 18, 2016

(30) Foreign Application Priority Data

Sep. 30, 2013 (JP) ..... 2013-205783

(51) Int. Cl.
*F25B 39/02* (2006.01)
*F28D 1/053* (2006.01)
(Continued)

(52) U.S. Cl.
CPC ..... *F28D 1/05391* (2013.01); *F25B 13/00* (2013.01); *F25B 39/00* (2013.01);
(Continued)

(58) Field of Classification Search
CPC ... F28D 1/05391; F28F 9/0202; F28F 9/0209; F28F 9/0212; F28F 9/028; F28F 9/027; F28F 9/0275; F25B 39/028; F25B 13/00
See application file for complete search history.

(56) References Cited

U.S. PATENT DOCUMENTS 5,203,407 A * 4/1993 Nagasaka ..... F28D 1/05375 165/174
6,769,269 B2 * 8/2004 Oh ..... F25B 39/04 62/507
(Continued)

FOREIGN PATENT DOCUMENTS

EP 1 042 641 B1 9/2003
JP 2-219966 A 9/1990
(Continued)

OTHER PUBLICATIONS

International Search Report of corresponding PCT Application No. PCT/JP2014/068464 dated Sep. 30, 2014.
(Continued)

*Primary Examiner* — Henry T Crenshaw
*Assistant Examiner* — Kamran Tavakoldavani
(74) *Attorney, Agent, or Firm* — Global IP Counselors, LLP

(57) ABSTRACT

A heat exchanger for an air conditioning device includes flat tubes, a vertically extending header collecting tube connected to the flat tubes, and fins joined to the flat tubes. The header collection tube has a loop structure including partition members, inflow ports, and upper and lower communicating passages. The partition members partition first and second spaces. The flat tubes are connected at the first spaces. The inflow ports are located in lower parts of the first spaces. The upper communicating passages communicate the upper parts of the first and second spaces to guide refrigerant from the first spaces into the second spaces. The
(Continued)

lower communicating passages communicate the lower parts of the first and second spaces to guide refrigerant from the second spaces towards spaces above the inflow ports in the first spaces to return the refrigerant from the second spaces to the first spaces.

9 Claims, 17 Drawing Sheets

(51) Int. Cl.

| | |
|---|---|
| ***F25B 13/00*** | (2006.01) |
| ***F25B 39/00*** | (2006.01) |
| ***F28F 9/02*** | (2006.01) |
| ***F28F 1/32*** | (2006.01) |
| ***F28F 1/30*** | (2006.01) |
| ***F28D 1/047*** | (2006.01) |

(52) U.S. Cl.
CPC ..... *F28D 1/0471* (2013.01); *F28F 1/30* (2013.01); *F28F 1/325* (2013.01); *F28F 9/0202* (2013.01); *F28F 9/027* (2013.01); *F28F 9/028* (2013.01); *F28F 9/0275* (2013.01); *F25B 39/028* (2013.01)

(56) References Cited

U.S. PATENT DOCUMENTS

| | | | | |
|---|---|---|---|---|
| 8,201,620 | B2 * | 6/2012 | Aung | F25B 39/022 165/11.1 |
| 2005/0262872 | A1 | 12/2005 | Sacks et al. | |
| 2007/0074861 | A1 | 4/2007 | Higashiyama | |
| 2010/0314090 | A1 * | 12/2010 | Moriya | F25B 39/028 165/174 |
| 2014/0338874 | A1 | 11/2014 | Jindou et al. | |

FOREIGN PATENT DOCUMENTS

| | | | | | |
|---|---|---|---|---|---|
| JP | 5-12636 | Y2 | | 3/1993 | |
| JP | 11-337293 | A | | 12/1999 | |
| JP | 2008-261518 | A | | 10/2008 | |
| JP | 2009-41876 | A | | 2/2009 | |
| JP | 2009041876 | A | * | 2/2009 | F25B 39/00 |
| JP | 2009041876 | A | * | 2/2009 | F28F 9/0214 |
| JP | 2013-130386 | A | | 7/2013 | |
| WO | 2007/094422 | A1 | | 8/2007 | |
| WO | 2013/076993 | A1 | | 5/2013 | |
| WO | 2013/099902 | A1 | | 7/2013 | |

OTHER PUBLICATIONS

International Preliminary Report of corresponding PCT Application No. PCT/JP2014/068464 dated Apr. 14, 2016.
European Search Report of corresponding EP Application No. 14 84 6790.5 dated May 10, 2017.

* cited by examiner

HEAT EXCHANGER AND AIR CONDITIONING DEVICE

CROSS-REFERENCE TO RELATED APPLICATIONS

This U.S. National stage application claims priority under 35 U.S.C. § 119(a) to Japanese Patent Application No. 2013-205783, filed in Japan on Sep. 30, 2013, the entire contents of which are hereby incorporated herein by reference.

TECHNICAL FIELD

The present invention relates to a heat exchanger and an air conditioning device.

BACKGROUND ART

Heat exchangers of a design having a plurality of flat tubes, fins which are joined to the plurality of flat tubes, and header collecting tubes which are coupled respectively to the plurality of flat tubes at a one end side and another end side thereof, for bringing about heat exchange between a refrigerant flowing through the interior the flat tubes and air flowing to the outside of the flat tubes, are known in the prior art.

For example, the heat exchanger disclosed in Japanese Laid-open Patent No. 2-219966 is configured such that a plurality of outflow tubes extending in a horizontal direction are connected at either end to header collecting tubes that respectively extend in a vertical direction.

The heat exchanger disclosed in Japanese Laid-open Patent No. 2-219966 is directed to the problem that, in the interior of the header collecting tubes that extend in the vertical direction, liquid phase refrigerant of high specific gravity collects towards the bottom while gas phase refrigerant of low specific gravity collects towards the top, thereby giving rise to eccentric flow; in order to solve this problem, the feature of forming a throttle inside the header collecting tubes is proposed.

Passing the refrigerant through the throttle formed in this manner facilitates mixing of the gas phase refrigerant and the liquid phase refrigerant, while at the same time improves the flow velocity, making it easy for the refrigerant to reach the top within the header collecting tubes, thereby minimizing eccentric flow of the refrigerant.

SUMMARY

Technical Problem

However, in a heat exchanger such as that disclosed in Japanese Laid-oven Patent No. 2-219966 above, it has in no way been contemplated to minimize eccentric flow such as may occur under conditions in which the circulation rate of the refrigerant varies; and no consideration whatsoever has been given to a structure that would afford the effect of minimizing eccentric flow, both in cases of a low circulation rate and in cases of a high circulation rate.

Specifically, in the case of a low circulation rate, it is possible to increase the flow velocity by forming a throttle, causing the refrigerant to reach the top within the header collecting tube, thereby minimizing eccentric flow; in the case of a high circulation rate, however, the flow velocity becomes too high due to the throttle, and the liquid phase refrigerant of high specific gravity collects to an excessive extent towards the top, giving rise in some instances to eccentric flow.

On the other hand, while, in cased of a high circulation rate, it is possible to minimize eccentric flow by providing a throttle that has been adjusted such that the flow velocity does not become too high, when the throttle is adjusted in this manner, in cases of a low circulation rate it may be difficult for the refrigerant to reach the top, giving rise in some instances to eccentric flow.

With the foregoing in view, it is an object of the present invention to provide a heat exchanger and an air conditioning device, with which it is possible to minimize eccentric flow of the refrigerant, even when employed under conditions in which the circulation rate varies.

Solution to Problem

The heat exchanger according to a first aspect of the present invention is provided with a plurality of flat tubes, a header collecting tube, and a plurality of fins. The plurality of flat tubes are arranged mutually. The header collecting tube has the one ends of the flat tubes connected thereto, and extends in a vertical direction. The plurality of fins are joined to the flat tubes. The header collecting tube has a loop structure. The loop structure includes partition members, inflow ports, upper communicating passages, and lower communicating passages. The partition members partition internal spaces into first spaces which are spaces to the side where the flat tubes are connected, and second spaces which are spaces to the side opposite from the side where the flat tubes are connected to the first space. The inflow ports are located in lower parts of the first spaces, and in the case of functioning as a refrigerant evaporator, prompt inflow of refrigerant so as to give rise to an ascending flow within the first spaces. The upper communicating passages are located in upper parts of the first spaces and the second spaces, and provide communication between the upper parts of the first spaces and the second spaces, thereby guiding the refrigerant which has ascended within the first spaces into the second spaces. The lower communicating passages are located in lower parts of the first spaces and the second spaces, provide communication between the lower parts of the first spaces and the second spaces, and by guiding the refrigerant in a direction other than vertical direction from the second spaces towards spaces above the inflow ports in the first spaces, guide the refrigerant from the first spaces to the second spaces, and return the refrigerant having descended through the second spaces from the second spaces to the first spaces. Herein, "inlet port" is used to include not only openings that are furnished to thin plate-shaped members, but where inflow passages formed to passage shape are provided, the outlets thereof as well. The "direction other than vertical direction" herein is not particularly limited provided that the direction is one leading from the second spaces to spaces above the inflow ports in the first spaces, and may include, for example, a horizontal direction leading from the second space side towards the first space side; a direction inclined towards the first space side from the second space side would also be acceptable. An incline of 60 degrees or less with respect to the horizontal direction would be an acceptable incline, as would one of 30 degrees or less; and an incline of −60 degrees or more with respect to the horizontal direction would be acceptable, as would one of −30 degrees or more.

With this heat exchanger, the internal spaces of the header collecting tube are partitioned by the partition members into the first spaces and the second spaces, whereby the area through which the refrigerant having flowed into the first spaces from the inflow ports passes while ascending through the first spaces can be made smaller, as compared with the case in which the first spaces and the second spaces are not partitioned by partition members. For this reason, even when the circulation rate of the refrigerant is a low circulation rate, the refrigerant having flowed into the first spaces from the inflow ports can be made to ascend through the narrow spaces of the first spaces only, whereby the refrigerant can easily reach the upper parts of the internal spaces of the header collecting tubes without experiencing any significant drop in the velocity of ascension of the refrigerant through the first spaces. For this reason, even when the circulation rate of the refrigerant is a low circulation rate, sufficient flow of the refrigerant to the flat tubes arranged towards the top is possible.

Moreover, in this heat exchanger, the header collecting tube has a loop structure that includes the inflow ports, the partition members, the upper communication passages, and the lower communication passages. For this reason, even when the flow velocity of the refrigerant inflowing to the first spaces from the inflow ports is fast, such as may be encountered at high circulation rates, and the high-specific gravity refrigerant passes forcefully while traversing the flat tubes located towards the bottom leading to a tendency to collect in upper parts of the first spaces, it is possible for the high-specific gravity refrigerant having reached upper sections of the first spaces to be returned back to the lower parts of the first spaces by means of the loop structure. Specifically, with this loop structure, it is possible for the refrigerant having reached upper sections of the first spaces to pass through the upper communicating passages and be fed to the second space side, and to then descend through the second spaces and flow through the lower communicating passages into lower parts of the first spaces, and thereby guided into the flat tubes that are present at the lower parts of the first spaces. For this reason, even when the flow velocity of the refrigerant inflowing to the first spaces is fast, such as may be encountered at high circulation rates, and the high-specific gravity refrigerant passes forcefully while traversing the flat tubes located towards the bottom leading to a tendency to collect in upper parts of the first spaces, sufficient flow of the refrigerant to the flat tubes at the bottom is possible.

In so doing, it is possible to keep eccentric flow of the refrigerant to flat tubes located at different heights to be kept to a minimum, even at times of a high circulation rate or at times of a low circulation rate.

A heat exchanger according to a second aspect of the present invention is the heat exchanger according to the first aspect of the present invention, wherein the lower communicating passages are disposed above the inflow ports, near the bottommost flat tubes above the inflow ports. The bottommost flat tubes above the inflow ports are those that are situated at bottommost locations among the flat tubes located above the inflow ports. Provided that the lower communicating passages of this heat exchanger are located above the inflow ports and near the bottommost flat tubes above the inflow ports, the passages may be disposed above the inflow ports at locations at the same height as the bottommost flat tubes above the inflow ports, or at places therebelow. It is also acceptable for only the outlets of the lower communicating passages to be located above the inflow port and near the bottommost flat tubes above the inflow ports.

With this heat exchanger, in cases in which the flow velocity of the refrigerant passing through the inflow ports is fast, such as is encountered in cases of a high circulation rate, in some instances the particularly high-velocity refrigerant having just passed through the inflow ports passes forcefully through the bottommost flat tubes above the inflow ports, which of those above the inflow ports are located furthest to the bottom, making inflow to the bottommost flat tubes above the inflow ports difficult. With this heat exchanger, however, even in such cases, the refrigerant having passed forcefully through the inflow ports is guided into the second spaces via the upper communicating passages in the upper parts of the first spaces, and after descending through the second spaces, passes through the lower communicating passages and towards the lower parts of the first spaces, making it possible to be sufficiently guided into the bottommost flat tubes above the inflow ports.

A heat exchanger according to a third aspect of the present invention is the heat exchanger according to the first or second aspect of the present invention, wherein flow regulation spaces are formed at the bottoms of the first spaces and second spaces among the internal spaces. The first and second spaces and the flow regulation spaces are partitioned by flow regulation members. The inflow ports are furnished to the flow regulation members, in such a way that the passage cross section area of the refrigerant going from the flow regulation spaces towards the first spaces can be throttled.

With this heat exchanger, the refrigerant flowing from the flow regulation spaces below to the first spaces above can be passed through the inflow ports which are disposed so as to throttle the passage cross section area. In so doing, the flow velocity of the flow of refrigerant passing from the flow regulation spaces to the first spaces through the inflow ports can be increased, and an ascending flow of the refrigerant through the first spaces can be easily produced. Additionally, because the first spaces, the second spaces, and the flow regulation spaces are disposed within the header collecting tube, there is no need to provide any arrangement, other than the header collecting tube, in order to produce an ascending flow of the refrigerant through the first spaces.

A heat exchanger according to a fourth aspect of the present invention is the heat exchanger according to the third aspect of the present invention, wherein the lower communicating passages are constituted by lower sections of the partition members and upper sections of the flow regulation members.

With this heat exchanger, because the lower communicating passages are constituted by lower sections of the partition members and upper sections of the flow regulation members, even if liquid phase refrigerant collects in the second spaces, the liquid phase refrigerant is caused to flow, due to gravity, towards the first space side along the upper sections of the flow regulation members and pass through the lower communicating passages, thereby making it possible to easily return to the first spaces.

A heat exchanger according to a fifth aspect of the present invention is the heat exchanger according to the any of the first to fourth aspects of the present invention, wherein the loop structure is arranged at locations such that, when a function as an evaporator for the refrigerant is performed, it is possible for the refrigerant, after having passed through a portion of the plurality of flat tubes, to flow in distributed fashion to another portion of the plurality of flat tubes.

With this heat exchanger, when a function as an evaporator for the refrigerant is performed, part of the refrigerant evaporates during passage through part of the plurality of flat tubes. For this reason, the refrigerant, after having passed through part of the plurality of flat tubes, is a mixture of a gas phase component and a liquid phase component. Unlike cases involving the gas phase only or the liquid phase only, when refrigerant containing such a mixture of a gas phase component and a liquid phase component differing in specific gravity passes through a header collecting tube of a heat exchanger of conventional construction, when the flow velocity is low, the liquid phase component tends to collect below and the gas phase component tends to collect above, whereas when the flow velocity is high, the liquid phase component tends to collect above and the gas phase component tends to collect below, making eccentric flow among the plurality of flat tubes arranged at different heights particularly prone to occur.

In contrast, with this heat exchanger, the loop structure is arranged at a location such that refrigerant containing a mixture of a gas phase component and a liquid phase component differing in specific gravity experiences further flow in distributed fashion to another part of the plurality of flat tubes, whereby it is possible to effectively minimize eccentric flow of the refrigerant flows.

A heat exchanger according to a sixth aspect of the present invention is the heat exchanger according to the fifth aspect of the present invention, wherein the plurality of flat tubes are connected at one ends thereof to a doubled-back header collecting tube that includes the header collecting tube and doubles back the refrigerant flow, and at the other ends are connected to a facing header collecting tube arranged facing the doubled-back header collecting tube. The plurality of flat tubes are grouped into an upper-side heat exchange area, and a lower-side heat exchange area located below the upper-side heat exchange area. The upper-side heat exchange area is constituted by one or plurality of upper-side heat exchange parts arrayed. The lower-side heat exchange area is constituted by one or plurality of lower-side heat exchange parts vertically arrayed. A facing lower-side internal space, corresponding to the lower-side heat exchange parts constituting the lower-side heat exchange area, is formed at the lower-side of the interior of the facing header collecting tube.

The interior of the doubled-back header collecting tube is partitioned on the vertical into doubled-back upper-side internal spaces and doubled-back lower-side internal spaces. The doubled-back upper-side internal spaces correspond in number to the number of the upper-side heat exchange parts constituting the upper-side heat exchange area. The doubled-back lower-side internal spaces correspond in number to the number of lower-side heat exchange parts constituting the lower-side heat exchange area. The doubled-back upper-side internal spaces and the doubled-back lower-side internal spaces communicate with one another. The loop structure is arranged in the doubled-back upper-side internal spaces.

With this heat exchanger, because a loop structure is arranged in the doubled-back upper-side internal spaces, it is possible for eccentric flowing of a gas-liquid two-phase refrigerant that contains a gas phase component having evaporated in the course of passage through the lower-side heat exchange area, and that is fed from the doubled-back lower-side internal spaces to the doubled-back upper-side internal spaces, to be effectively minimized when the refrigerant flows towards the upper-side heat exchange parts.

An air conditioning device according to a seventh aspect of the present invention is provided with a refrigerant circuit. The refrigerant circuit is constituted by connecting the heat exchanger according to any of the first to sixth aspects of the present invention, and a variable-capacity compressor.

With this air conditioning device, driving by the variable-capacity compressor causes the rate at which the refrigerant flowing circulates through the refrigerant circuit to fluctuate, and the amount of refrigerant passing through the heat exchanger to fluctuate. In cases in which the heat exchanger functions as an evaporator, it will be possible to keep eccentric flow of the refrigerant within the heat exchanger to a minimum, even when the amount of the refrigerant passing therethrough increases and the mixture ratio of liquid phase refrigerant increases, or the flow velocity increases.

Advantageous Effects of Invention

With the heat exchanger according to the first aspect of the present invention, it is possible minimize eccentric flow of the refrigerant to flat tubes located at different heights, both during times of a low circulation rate and times of a high circulation rate.

With the heat exchanger according to the second aspect of the present invention, it is possible for the refrigerant to be sufficiently guided to the bottommost flat tubes above the inflow ports.

With the heat exchanger according to the third aspect of the present invention, an ascending flow of refrigerant in the first spaces is easily produced by the header collecting tube alone.

With the heat exchanger according to the fourth aspect of the present invention, it is possible for liquid phase refrigerant collecting in the second spaces to be easily returned to the first spaces.

With the heat exchanger according to the fifth aspect of the present invention, it is possible to effectively minimize eccentric flow of the refrigerant flow.

With the heat exchanger according to the sixth aspect of the present invention, it is possible to effectively minimize eccentric flow of the refrigerant flow as a gas-liquid two-phase refrigerant in the first upper-side internal spaces flows towards the upper-side heat exchange parts.

With the air conditioning device according to the seventh aspect of the present invention, in cases in which the heat exchanger functions as an evaporator, it is possible to keep eccentric flow of the refrigerant within the heat exchanger to a minimum, even when the amount of the refrigerant passing therethrough increases and the mixture ratio of liquid phase refrigerant increases, or the flow velocity increases.

BRIEF DESCRIPTION THE DRAWINGS

DESCRIPTION OF EMBODIMENTS

(1) Overall Configuration of Air Conditioning Device 1

Figure 1:
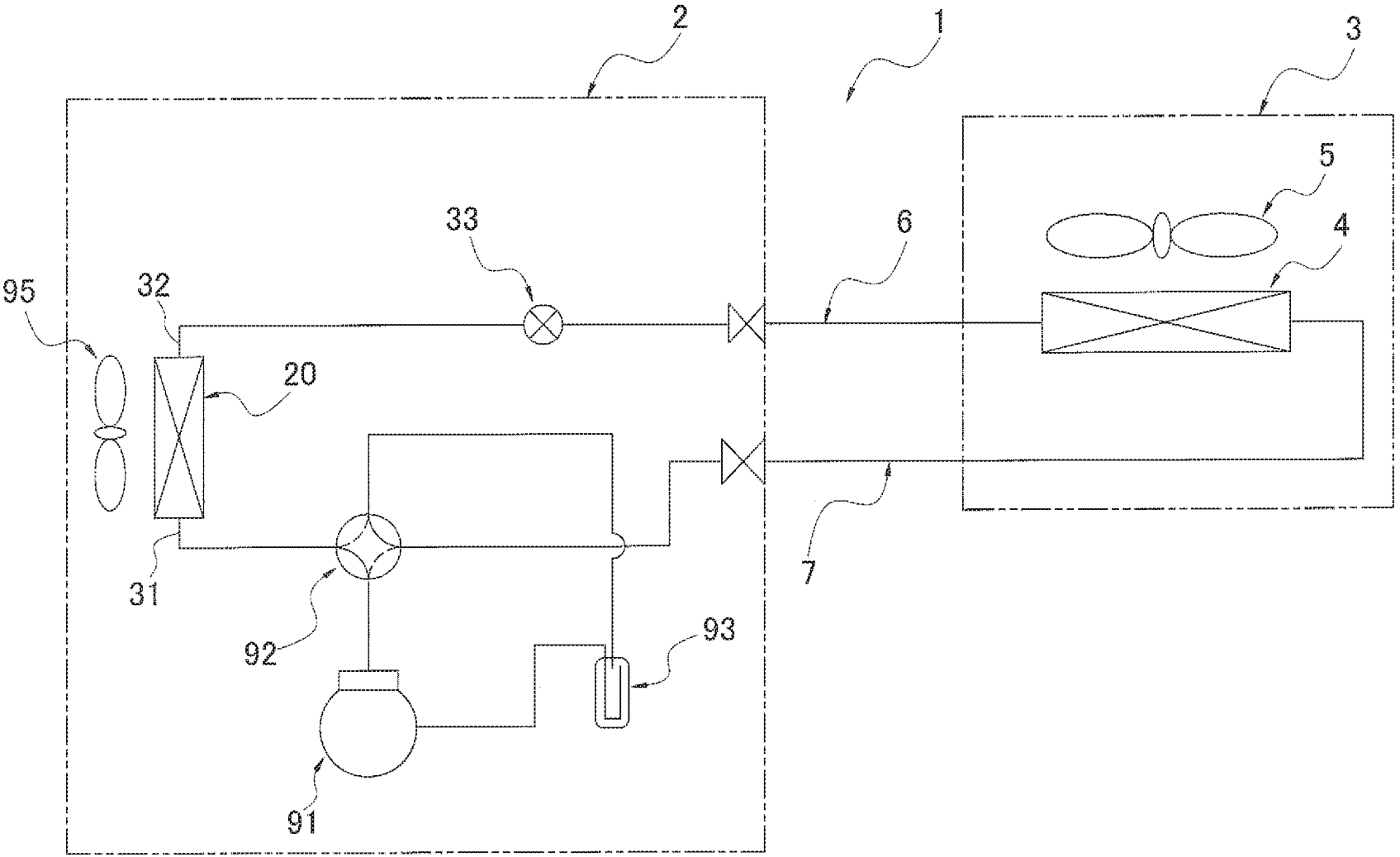
FIG. 1 is a circuit diagram of overview of the scheme of an air conditioning device according to an embodiment.

FIG. 1 is a circuit diagram describing an overview of a configuration of an air conditioning device 1 according to an embodiment of the present invention.

This air conditioning device 1 is a device used for cooling and heating, through vapor compression refrigerating cycle operation, of a building interior in which an air conditioning indoor unit 3 has been installed, and is constituted by an air conditioning outdoor unit 2 as a heat source-side unit and the air conditioning indoor unit 3 as a user-side unit, which are connected by refrigerant interconnecting pipelines 6, 7.

The refrigerant circuit constituted by connection of the air conditioning outdoor unit 2, the air conditioning indoor unit 3, and the refrigerant interconnecting pipelines 6, 7 is further constituted by connecting a compressor 91, a four-way switching valve 92, an outdoor heat exchanger 20, an expansion valve 33, an indoor heat exchanger 4, an accumulator 93, and the like, through refrigerant pipelines. A refrigerant is sealed within this refrigerant circuit, and refrigerating cycle operation involving compression, cooling, depressurization, and heating/evaporation of the refrigerant, followed by re-compression, is carried out. As the refrigerant, there may be employed one selected, for example, from R410A, R32, R407C, R22, R134a, carbon dioxide, and the like.

(2) Detailed Configuration of Air Conditioning Device 1

(2-1) Air Conditioning Indoor Unit 3

The air conditioning indoor unit 3 is installed by being wall-mounted on an indoor wall or the like, or by being recessed within or suspended from an indoor ceiling of a building or the like. The air conditioning indoor unit 3 includes the indoor heat exchanger 4 and an indoor fan 5. The indoor heat exchanger 4 is, for example, a fin-and-tube heat exchanger of cross fin type, constituted by a heat transfer tube and a multitude of fins. In cooling mode, the heat exchanger functions as an evaporator for the refrigerant to cool the indoor air, and in heating mode functions as a condenser for the refrigerant to heat the indoor air.

(2-2) Air Conditioning Outdoor Unit 2

Figure 2:
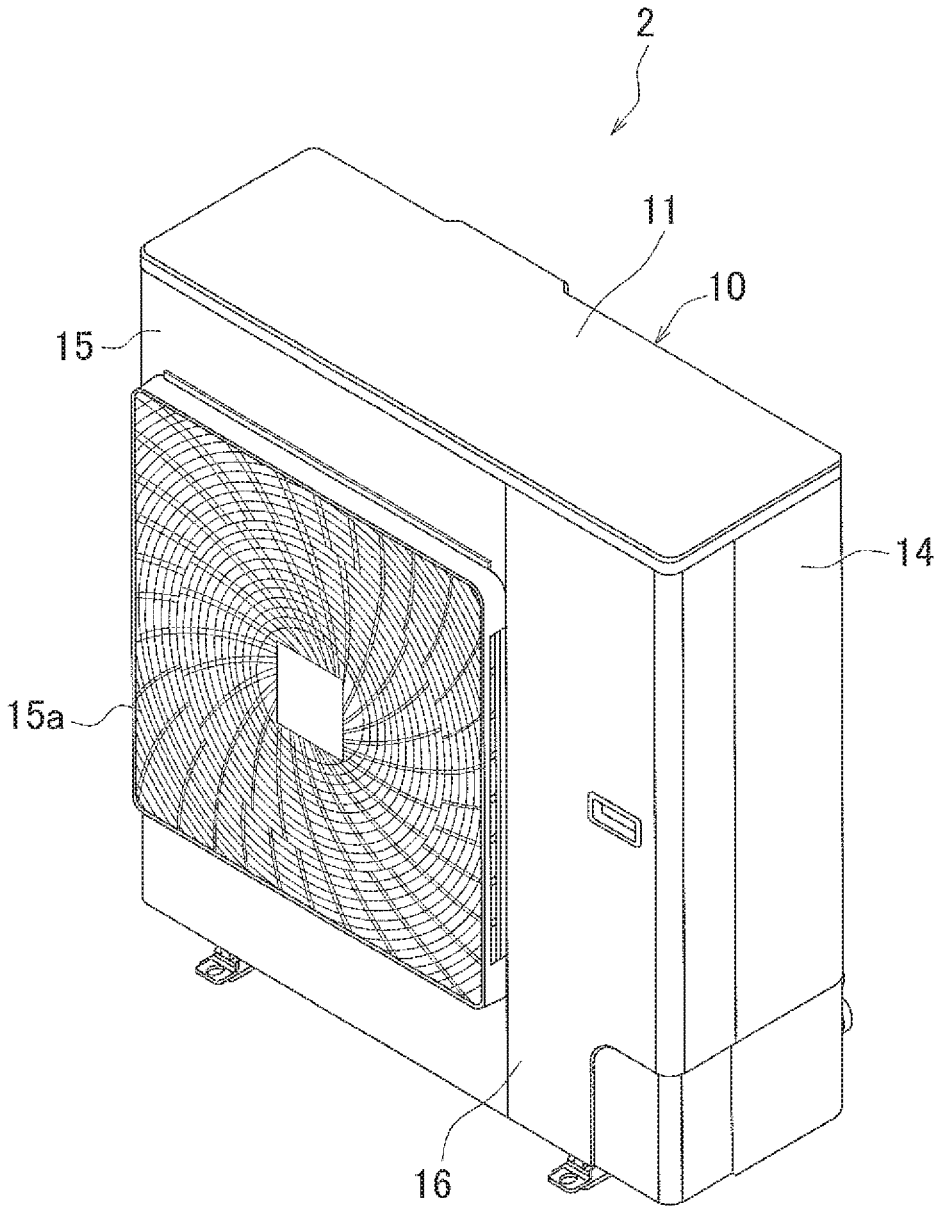
FIG. 2 is a perspective view of the exterior of an air conditioning outdoor unit.
Figure 3:
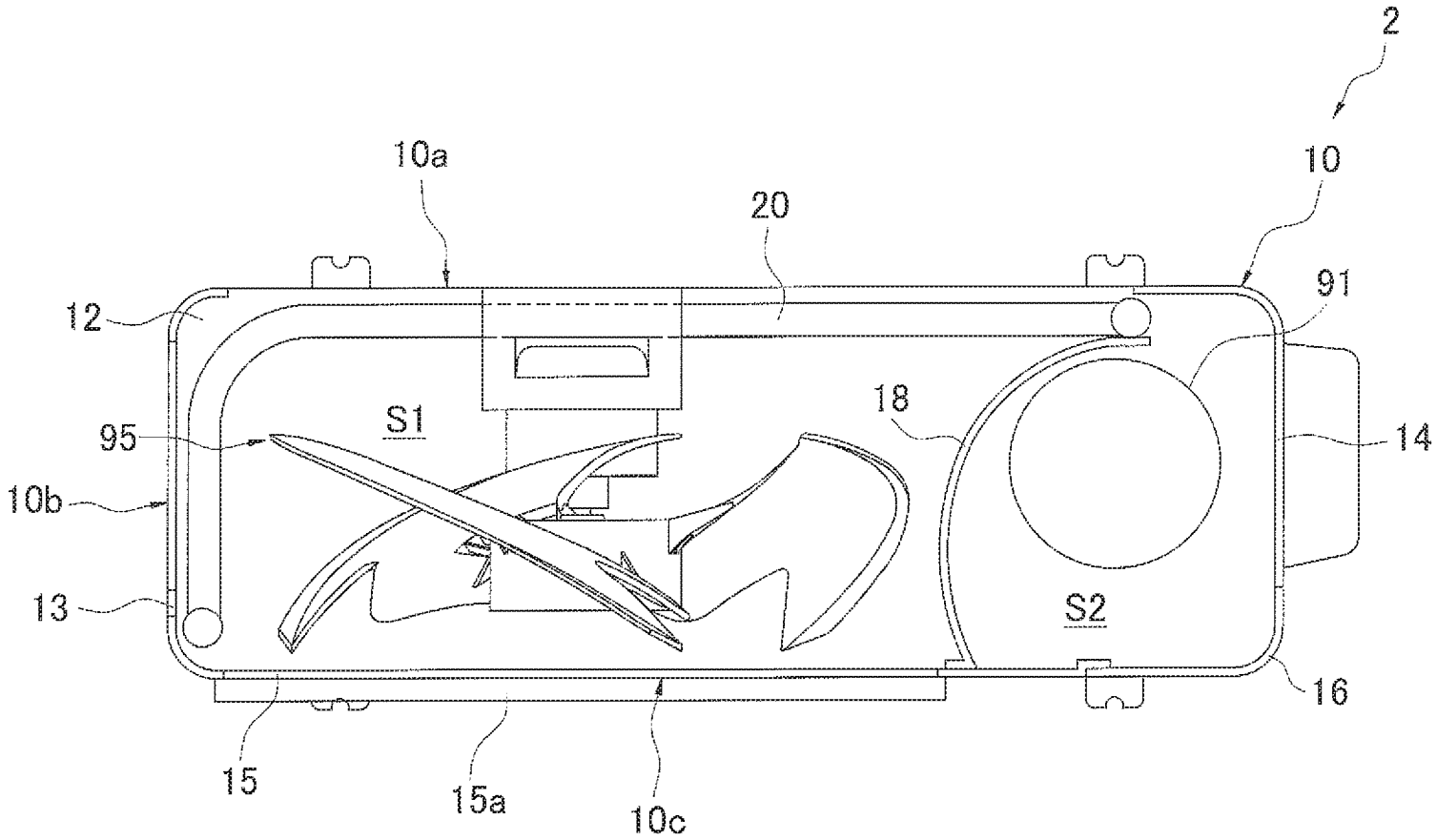
FIG. 3 is a schematic cross sectional view of an overview of placement of machinery of an air conditioning outdoor unit.

The air conditioning outdoor unit 2 is installed outside a building or the like, and is connected to the air conditioning indoor unit 3 by the refrigerant interconnecting pipelines 6, 7. As shown in FIG. 2 and FIG. 3, the air conditioning outdoor unit 2 has a unit casing 10 of substantially cuboid shape.

As shown in FIG. 3, the air conditioning outdoor unit 2 has a structure (a "trunk" type structure) in which a blower chamber S1 and a machinery chamber S2 are formed by dividing an internal space of the unit casing 10 into two by a partition panel 18 that extends in a vertical direction. The air conditioning outdoor unit 2 includes an outdoor heat exchanger 20 and an outdoor fan 95 which are arranged within the blower chamber S1 of the unit casing 10, and also includes the compressor 91, the four-way switching valve 92, the accumulator 93, the expansion valve 33, a gas refrigerant pipeline 31, and a liquid refrigerant pipeline 32 which are arranged within the machinery chamber S2 of the unit casing 10.

The unit casing 10 constitutes a chassis and is provided with a bottom panel 12, a top panel 11, a side panel 13 at the blower chamber side, a side panel 14 at the machinery chamber side, a blower chamber-side front panel 15, and a machinery chamber-side front panel 16.

The air conditioning outdoor unit 2 is configured in such a way that outdoor air is sucked into the blower chamber S1 within the unit casing 10 from parts of the rear surface and the side surface of the unit casing 10, and the sucked outdoor air is vented from the front surface of the unit casing 10. In specific terms, an intake port 10*a* and an intake port 10*b* facing the blower chamber S1 within the unit casing 10 are formed between the rear face-side end of the side panel 13 at the blower chamber side and the blower chamber S1-side end of the side panel 14 at the machinery chamber side. The blower chamber-side front panel 15 is furnished with a vent 10*c*, the front side thereof being covered by a fan grill 15*a*.

The compressor 91 is, for example, a sealed compressor driven by a compressor motor, and is configured such that the operating capacity can be varied through inverter control.

The four-way switching valve 92 is a mechanism for switching the direction of flow of the refrigerant. In cooling mode, the four-way switching valve 92 connects a refrigerant pipeline which extends from the discharge side of the compressor 91 and the gas refrigerant pipeline 31 which extends from a one end (the gas-side end) of the outdoor heat exchanger 20, as well as connecting, via the accumulator 93, the refrigerant interconnecting pipeline 7 for the gas refrigerant and the refrigerant pipeline at the intake side of the compressor 91 (see the solid lines of the four-way switching valve 92 in FIG. 1). In heating mode, the four-way switching valve 92 connects the refrigerant pipeline which extends from the discharge side of the compressor 91 and the refrigerant interconnecting pipeline 7 for the gas refrigerant, as well as connecting, via the accumulator 93, the intake side of the compressor 91 and the gas refrigerant pipeline 31 which extends from the one end (the gas-side end) of the outdoor heat exchanger 20 (see the broken lines of the four-way switching valve 92 in FIG. 1).

The outdoor heat exchanger 20 is arranged upright in a vertical direction in the blower chamber S1, and faces the intake ports 10*a*, 10*b*. The outdoor heat exchanger 20 is a heat exchanger made of aluminum; in the present embodiment, one having design pressure of about 3-4 MPa is employed. The gas refrigerant pipeline 31 extends from the one end (the gas-side end) of the outdoor heat exchanger 20, so as to connect to the four-way switching valve 92. The liquid refrigerant pipeline 32 extends from the other end (the liquid-side end) of the outdoor heat exchanger 20, so as to connect to the expansion valve 33.

The accumulator 93 is connected between the four-way switching valve 92 and the compressor 91. The accumulator 93 is equipped with a gas-liquid separation function for separating the refrigerant into a gas phase and a liquid phase. Refrigerant inflowing to the accumulator 93 is separated into the gas phase and the liquid phase, and the gas phase refrigerant which collects in the upper spaces is supplied to the compressor 91.

The outdoor fan 95 supplies the outdoor heat exchanger 20 with outdoor air for heat exchange with the refrigerant flowing through the outdoor heat exchanger 20.

The expansion valve 33 is a mechanism for depressurizing the refrigerant in the refrigerant circuit, and is an electrically-operated valve, the valve opening of which is adjustable. In order to make adjustments to the refrigerant pressure and the refrigerant flow rate, the expansion valve 33 is disposed between the outdoor heat exchanger 20 and the refrigerant interconnecting pipeline 6 for the liquid refrigerant, and has the function of expanding the refrigerant, both in cooling mode and heating mode.

The outdoor fan 95 is arranged facing the outdoor heat exchanger 20 in the blower chamber S1. The outdoor fan 95 sucks outdoor air into the unit, and after heat exchange between the outdoor air and the refrigerant has taken place in the outdoor heat exchanger 20, discharges the heat-exchanged air to the outdoors. This outdoor fan 95 is a fan in which it is possible to adjust the air volume of the air supplied to the outdoor heat exchanger 20, and could be, for example, a propeller fan driven by a motor, such as a DC fan motor, or the like.

(3) Operation of Air Conditioning Device 1

(3-1) Cooling Mode

In cooling mode, the four-way switching valve 92 enters the state shown by the solid lines in FIG. 1, i.e., a state in which the discharge side of the compressor 91 is connected to the gas side of the outdoor heat exchanger 20 via the gas refrigerant pipeline 31, and the intake side of the compressor 91 is connected to the gas side of the indoor heat exchanger 4 via the accumulator 93 and the refrigerant interconnecting pipeline 7. The design of the expansion valve 33 is such that valve opening adjustments are made to maintain a constant degree of superheat (degree of superheat control) of the refrigerant at the outlet of the indoor heat exchanger 4 (i.e., the gas side of the indoor heat exchanger 4). With the refrigerant circuit in this state, when the compressor 91, the outdoor fan 95, and the indoor fan 5 are run, low-pressure gas refrigerant is compressed by the compressor 91 to become high-pressure gas refrigerant. This high-pressure gas refrigerant is fed to the outdoor heat exchanger 20 through the four-way switching valve 92. Subsequently, the high-pressure gas refrigerant undergoes heat exchange in the outdoor heat exchanger 20 with outdoor air supplied by the outdoor fan 95, and is condensed to become high-pressure liquid refrigerant. The high-pressure liquid refrigerant, now in a supercooled state, is fed to the expansion valve 33 from the outdoor heat exchanger 20. Refrigerant having been depressurized to close to the intake pressure of the compressor 91 by the expansion valve 33 and entered a low-pressure, gas-liquid two-phase state is fed to the indoor heat exchanger 4, and undergoes heat exchange with indoor air in the indoor heat exchanger 4, evaporating to become low-pressure gas refrigerant.

This low-pressure gas refrigerant is fed to the air conditioning outdoor unit 2 through the refrigerant interconnecting pipeline 7, and is again sucked into the compressor 91. In this cooling mode, the air conditioning device 1 prompts the outdoor heat exchanger 20 to function as a condenser for the refrigerant compressed in the compressor 91, and the indoor heat exchanger 4 to function as an evaporator for the refrigerant condensed in the outdoor heat exchanger 20.

In the refrigerant circuit during cooling mode, while degree of superheat control by the expansion valve 33 is taking place, the compressor 91 is inverter-controlled to a set temperature (such that the cooling load can be processed), and therefore the circulation rate of the refrigerant may be a high circulation rate in some cases, and a low circulation rate in others.

(3-2) Heating Mode

In heating mode, the four-way switching valve 92 enters the state shown by broken lines in FIG. 1, i.e., a state in which the discharge side of the compressor 91 is connected to the gas side of the indoor heat exchanger 4 via the refrigerant interconnecting pipeline 7, and the intake side of the compressor 91 is connected to the gas side of the outdoor heat exchanger 20 via the gas refrigerant pipeline 31. The design of the expansion valve 33 is such that valve opening adjustments are made to maintain the degree of supercooling of the refrigerant at the outlet of the indoor heat exchanger 4 at a target degree of supercooling value (degree of supercooling control). With the refrigerant circuit in this state, when the compressor 91, the outdoor fan 95, and the indoor fan 5 are run, low-pressure gas refrigerant is sucked into and compressed by the compressor 91 to become high-pressure gas refrigerant, and is fed to the air conditioning indoor unit 3 through the four-way switching valve 92 and the refrigerant interconnecting pipeline 7.

The high-pressure gas refrigerant fed to the air conditioning indoor unit 3 then undergoes heat exchange with indoor air in the indoor heat exchanger 4, and is condensed to become high-pressure liquid refrigerant, then while passing through the expansion valve 33 is depressurized to an extent commensurate with the valve opening of the expansion valve 33. The refrigerant having passed through the expansion valve 33 flows into the outdoor heat exchanger 20. The refrigerant in a low-pressure, gas-liquid two-phase state having flowed into the outdoor heat exchanger 20 undergoes heat exchange with outdoor air supplied by the outdoor fan 95, evaporates to become low-pressure gas refrigerant, and is again sucked into the compressor 91 through the four-way switching valve 92. In this heating mode, the air conditioning device 1 prompts the indoor heat exchanger 4 to function as a condenser for the refrigerant compressed in the compressor 91, and the outdoor heat exchanger 20 to function as an evaporator for the refrigerant condensed in the indoor heat exchanger 4.

In the refrigerant circuit during heating mode, while degree of supercooling control by the expansion valve 33 is taking place, the compressor 91 is inverter-controlled to a set temperature (such that the heating load can be processed), and therefore the circulation rate of the refrigerant may be a high circulation rate in some cases, and a low circulation rate in others.

(4) Detailed Configuration of the Outdoor Heat Exchanger 20

(4-1) Overall Configuration of the Outdoor Heat Exchanger 20

Figure 4:
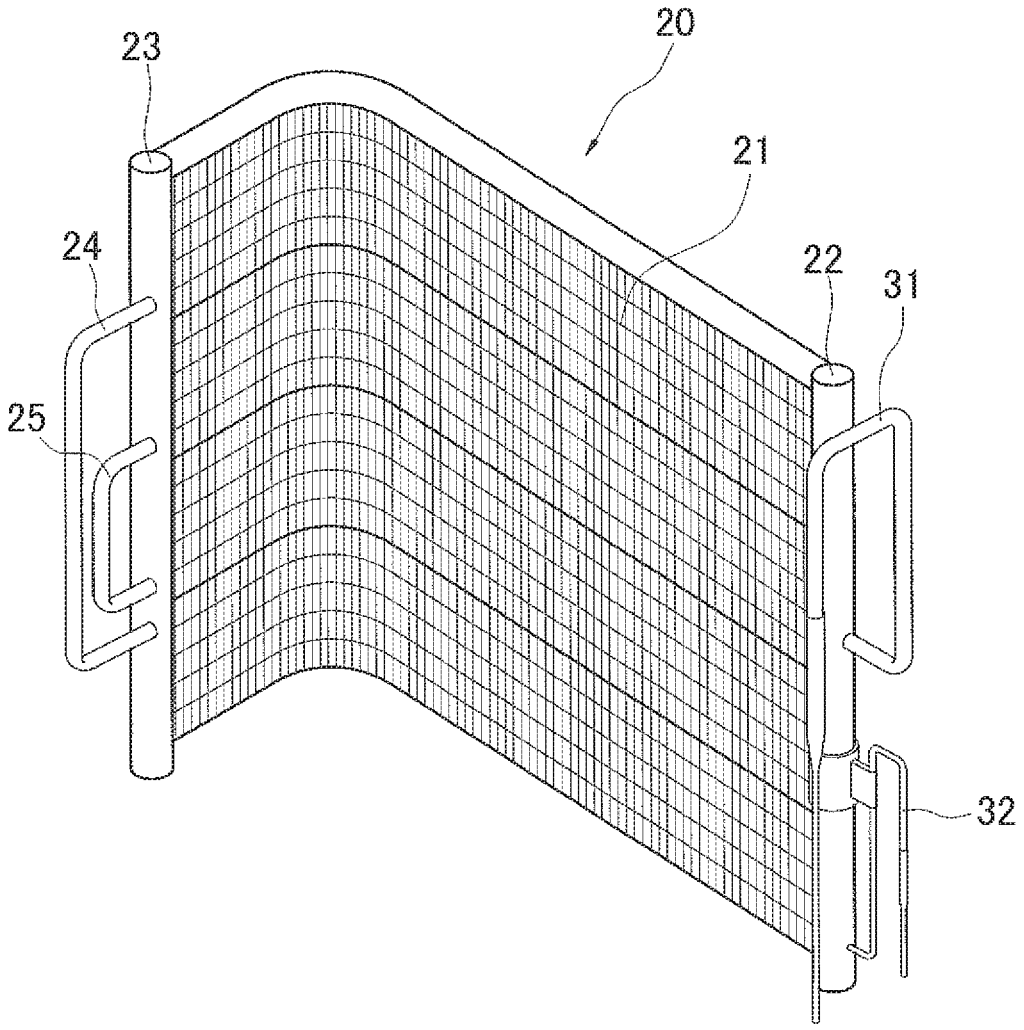
FIG. 4 is an exterior simplified perspective view of an outdoor heat exchanger, a gas refrigerant pipeline, and a liquid refrigerant pipeline.
Figure 5:
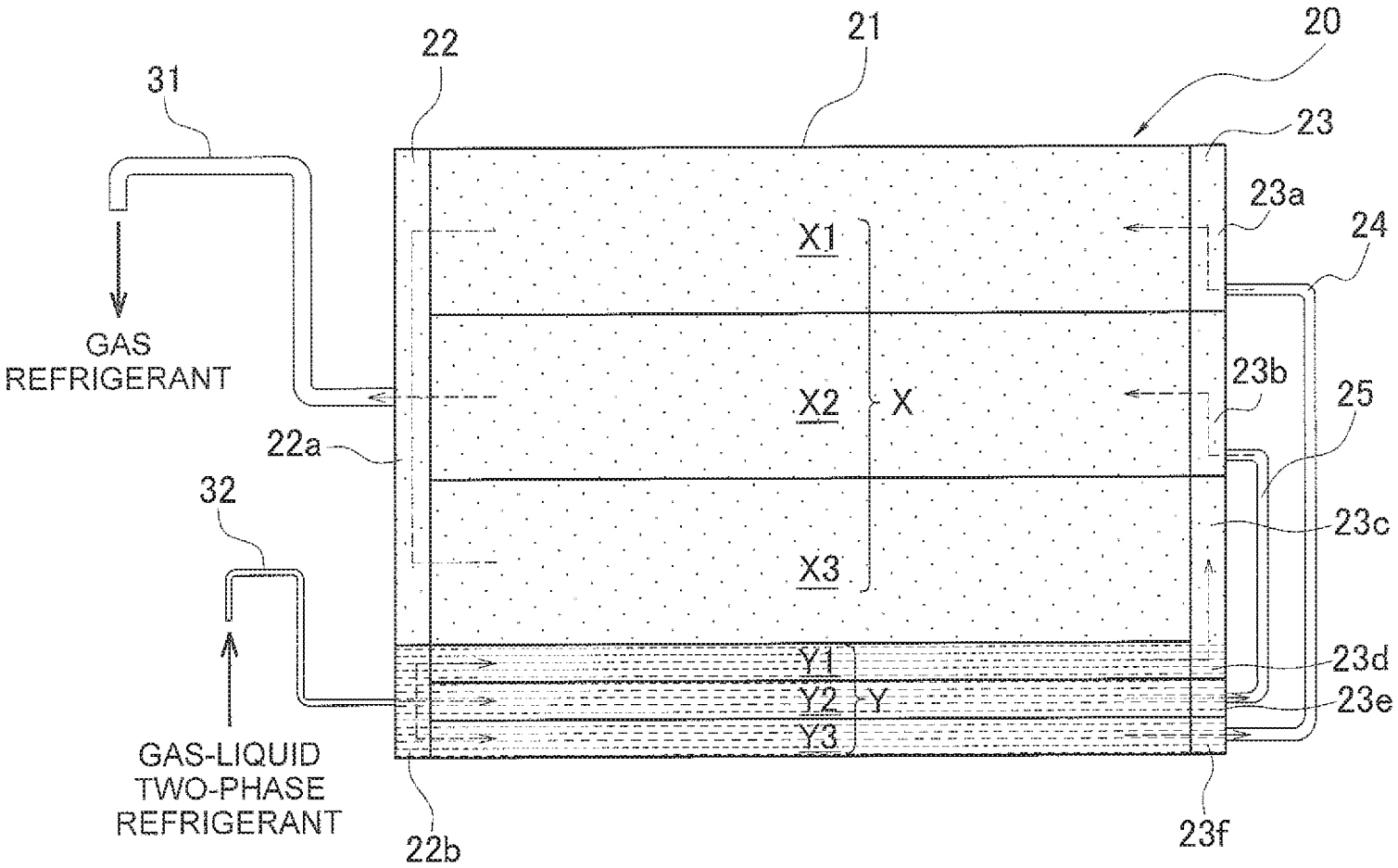
FIG. 5 is a schematic rear view of a simplified configuration of an outdoor heat exchanger.

Next, the configuration of the outdoor heat exchanger 20 will be described using FIG. 4 showing an exterior simplified perspective view of the outdoor heat exchanger 20, FIG. 5 showing a schematic rear view of the outdoor heat exchanger, and FIG. 6 which is a simplified rear view.

The outdoor heat exchanger 20 is provided with a heat exchange part 21 where heat exchange takes place between outdoor air and the refrigerant, an outlet/inlet header collecting tube 22 disposed at a one end of this heat exchange part 21, and a doubled-back header collecting tube 23 disposed at the other end of this heat exchange part 21.

(4-2) Heat Exchange Part 21

Figure 7:
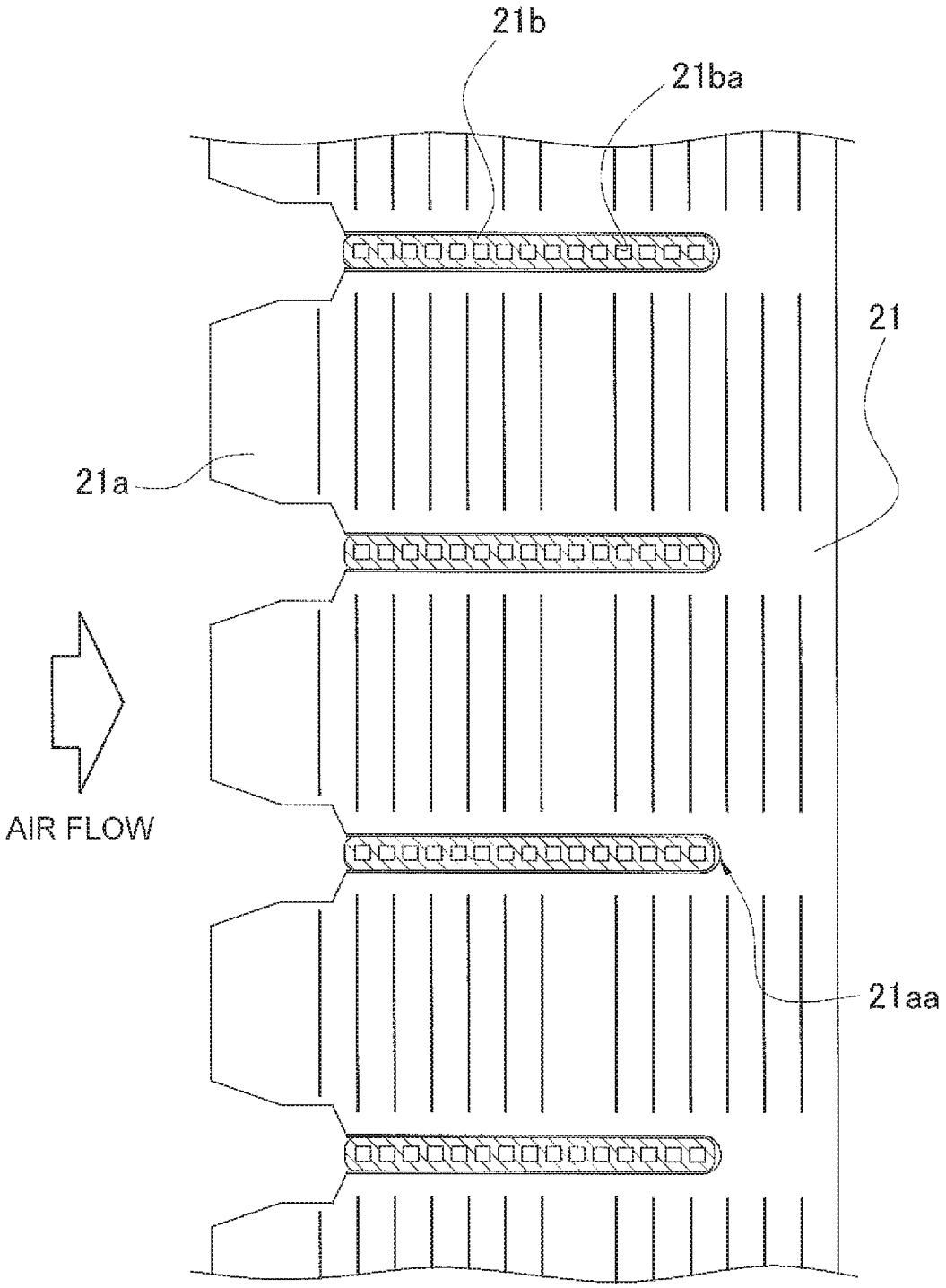
FIG. 7 is a fragmentary enlarged cross sectional view of a configuration of a heat exchange part of an outdoor heat exchanger.
Figure 8:
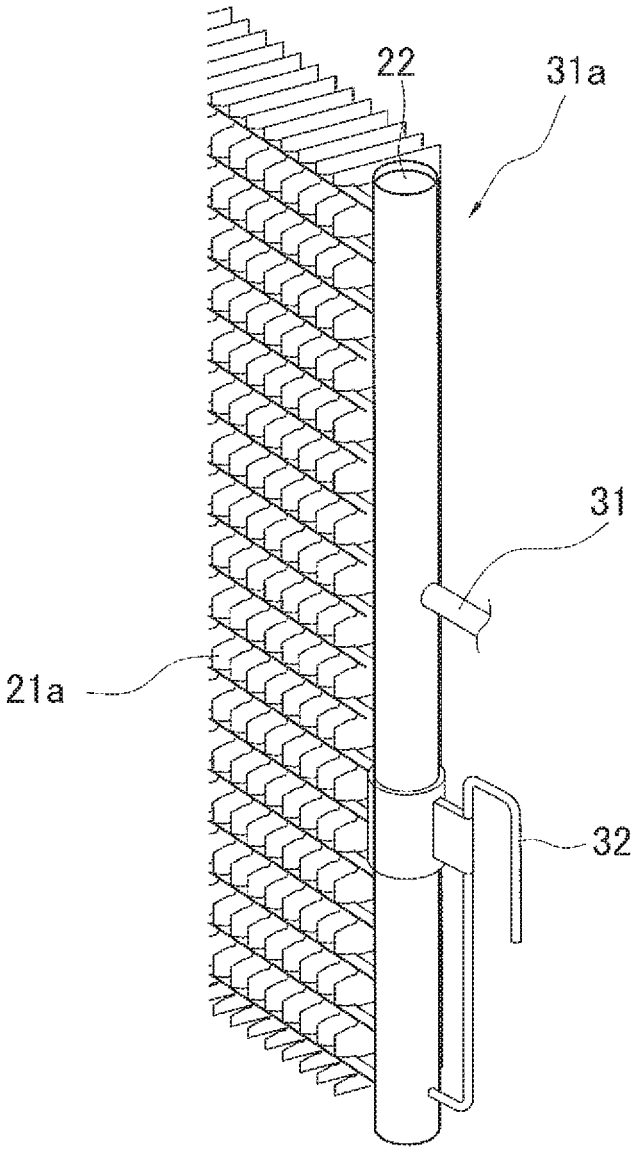
FIG. 8 is a simplified perspective view of heat transfer fins attached to an outdoor heat exchanger.

FIG. 7 is a fragmentary enlarged cross sectional view of a cross sectional structure of the heat exchange part 21 of the outdoor heat exchanger 20, in a plane perpendicular to the direction of flattening of flat perforated tubes 21*b* thereof. FIG. 8 is a simplified perspective view of heat transfer fins 21*a* attached in the outdoor heat exchanger 20.

The heat exchange part 21 has an upper-side heat exchange area X located at the upper side, and a lower-side heat exchange area Y located below the upper-side heat exchange area X. Among these, the upper-side heat exchange area X has a first upper-side heat exchange part X1, a second upper-side heat exchange part X2, and a third upper-side heat exchange part X3, arranged in that order from the top. The lower-side heat exchange area Y has a first lower-side heat exchange part Y1, and a second lower-side heat exchange part Y2, and a third lower-side heat exchange part Y3, arranged in that order from the top.

This heat exchange part 21 is constituted by a multitude of the heat transfer fins 21*a* and a multitude of the flat perforated tubes 21*b*. The heat transfer fins 21*a* and the flat perforated tubes 21*b* are both fabricated from aluminum or aluminum alloy.

The heat transfer fins 21*a* are flat members, and a plurality of cutouts 21*aa* extending in a horizontal direction for insertion of flattened tubes are formed side by side in a vertical direction in the heat transfer fins 21*a*. The heat transfer fins 21*a* are attached so as to have innumerable sections protruding towards the upstream side of the air flow.

The flat perforated tubes 21*b* function as heat transfer tubes for transferring heat moving between the heat transfer fins 21*a* and the outside air to the refrigerant flowing through the interior. The flat perforated tubes 21*b* have upper and lower flat surfaces serving as heat transfer surfaces, and a plurality of internal channels 21*ba* through which the refrigerant flows. The flat perforated tubes 21*b*, which are slightly thicker in vertical breadth than the cutouts 21*aa*, are arrayed spaced apart in a plurality of tiers with the heat transfer surfaces facing up and down, and are temporarily fastened by being fitted into the cutouts 21*aa*. With the flat perforated tubes 21*b* temporarily fastened by being fitted into the cutouts 21*aa* of the heat transfer fins 21*a* in this manner, the heat transfer fins 21*a* and the flat perforated tubes 21*b* are brazed. The flat perforated tubes 21*b* are fitted at either end into the outlet/inlet header collecting tube 22 and the doubled-back header collecting tube 23, respectively, and brazed. In so doing, an upper outlet/inlet internal space 22*a* and a lower outlet/inlet internal space 22*b* in the outlet/inlet header collecting tube 22, discussed below, and/or first to sixth internal spaces 23*a*, 23*b*, 23*c*, 23*d*, 23*e*, 23*f* of the doubled-back header collecting tube 23, and internal flow channels 21*ba* of the flat perforated tubes 21*b*, discussed below, are linked.

As shown in FIG. 7, the heat transfer fins 21*a* link up on the vertical, and therefore any dew condensation occurring on the heat transfer fins 21*a* and/or the flat perforated tubes 21*b* will drip down along the heat transfer fins 21*a* and drain to the outside through a path formed in the bottom panel 12.

(4-3) Outlet/Inlet Header Collecting Tube 22

The outlet/inlet header collecting tube 22 is a cylindrical member made of aluminum or aluminum alloy, disposed at a one end of the heat exchange part 21, and extending in the vertical direction.

The outlet/inlet header collecting tube 22 includes the upper outlet/inlet internal spaces 22*a*, 22*b* which are partitioned off in the vertical direction by a first baffle 22*c*. The gas refrigerant pipeline 31 is connected to the upper outlet/inlet internal space 22*a* in a top part, and the liquid refrigerant pipeline 32 is connected to the lower outlet/inlet internal space 22*b* in a bottom part.

Both the upper outlet/inlet internal space 22*a* in the top part of the outlet/inlet header collecting tube 22 and the lower outlet/inlet internal space 22*b* in the bottom part are connected to one ends of the plurality of flat perforated tubes 21*b*. More specifically, the first upper-side heat exchange part X1, the second upper-side heat exchange part X2, and the third upper-side heat exchange part X3 of the upper-side heat exchange area X are disposed in such a way as to correspond to the upper outlet/inlet internal space 22*a* in the top part of the outlet/inlet header collecting tube 22. The first lower-side heat exchange part Y1, the second lower-side heat exchange part Y2, and the third lower-side heat exchange part Y3 of the lower-side heat exchange area Y are disposed in such a way as to correspond to the lower outlet/inlet internal space 22*b* in the bottom part of the outlet/inlet header collecting tube 22.

(4-4) Doubled-Back Header Collecting Tube 23

The doubled-back header collecting tube 23 is a cylindrical member made of aluminum or aluminum alloy, disposed at the other end of the heat exchange part 21, and extending in the vertical direction.

The interior of the doubled-back header collecting tube 23 is partitioned in the vertical direction by a second baffle 23*g*, a third baffle 23*h*, a third flow regulation plate 43, a fourth baffle 23*i*, and a fifth baffle 23*j*, forming the first to sixth internal spaces 23*a*, 23*b*, 23*c*, 23*d*, 23*e*, 23*f*.

Of these, the three first to third internal spaces 23*a*, 23*b*, 23*c* of the doubled-back header collecting tube 23 are connected to the other ends of a multitude of the flat perforated tubes 21*b* which are connected at their one ends to the upper outlet/inlet internal space 22*a* at the top of the outlet/inlet header collecting tube 22. Specifically, the first upper-side heat exchange part X1 of the upper-side heat exchange area X is disposed in such a way as to correspond to the first internal space 23*a* of the doubled-back header collecting tube 23, the second upper-side heat exchange part X2 of the upper-side heat exchange area X in such a way as to correspond to the second internal space 23*b* of the doubled-back header collecting tube 23, and the third upper-side heat exchange part X3 of the upper-side heat exchange area X in such a way as to correspond to the third internal space 23*c* of the doubled-back header collecting tube 23, respectively.

The multitude of flat perforated tubes 21*b* connected at their one ends to the lower outlet/inlet internal space 22*b* in the bottom part of the outlet/inlet header collecting tube 22 connect at their other ends to the three fourth internal spaces 23*d*, 23*e*, 23*f* of the doubled-back header collecting tube 23. Specifically, the first lower-side heat exchange part Y1 of the lower-side heat exchange area Y is disposed in such a way as to correspond to the fourth internal space 23*d* of the doubled-back header collecting tube 23, the second lower-side heat exchange part Y2 of the lower-side heat exchange area Y in such a way as to correspond to the fifth internal space 23*e* of the doubled-back header collecting tube 23, and the third lower-side heat exchange part Y3 of the lower-side heat exchange area Y in such a way as to correspond to the sixth internal space 23*f* of the doubled-back header collecting tube 23, respectively.

The first internal space 23*a* of the topmost tier and the internal space 23*k* of the bottommost tier of the doubled-back header collecting tube 23 are connected by an interconnecting pipeline 24.

The second internal space 23*b* of the second tier from the top and the fifth internal space 23*e* of the second tier from the bottom are connected by an interconnecting pipeline 25.

The third internal space 23*c* of the third tier from the top and the fourth internal space 23*d* of the third tier from the bottom are partitioned apart by the third flow regulation plate 43, but have sections that communicate vertically via a third inflow port 43*x* disposed in the third flow regulation plate 43.

The design is such that the number of flat perforated tubes 21*b* into which refrigerant flowing in from the interconnecting pipeline 24 branches in the first internal space 23*a* of the doubled-back header collecting tube 23 is greater than the number of flat perforated tubes 21*b* into which the refrigerant flowing from the liquid refrigerant pipeline 32 branches in the lower outlet/inlet internal space 22*b* of the outlet/inlet header collecting tube 22 as the refrigerant advances to the sixth internal space 23*f* (the same holds for the relationship of the numbers of the flat perforated tubes 21*b* of the second internal space 23*b* and the fifth internal space 23*e*, and/or the relationship of the numbers of the flat perforated tubes 21*b* of the third internal space 23*c* and the fourth internal space 23*d*). While different arrangements may be employed in order to optimize distribution of the refrigerant, in the present embodiment, the number of the flat perforated tubes 21*b* connected to the first internal space 23*a*, the number of the flat perforated tubes 21*b* connected to the second internal space 23*b*, and the number of the flat perforated tubes 21*b* connected to the third internal space 23*c* are substantially equal. Likewise, while different arrangements may be employed in order to optimize distribution of the refrigerant, in the present embodiment, the number of the flat perforated tubes 21*b* connected to the fourth internal space 23*d*, the number of the flat perforated tubes 21*b* connected to the fifth internal space 23*e*, and the number of the flat perforated tubes 21*b* connected to the sixth internal space 23*f* are substantially equal.

(4-5) Loop Structure of Doubled-Back Header Collecting Tube 23

In the doubled-back header collecting tube 23, the upper three first to third internal spaces 23*a*, 23*b*, 23*c* are furnished with a loop structure and with a flow regulating structure. The loop structure and a flow regulating structure of the first to third internal spaces 23*a*, 23*b*, 23*c*, respectively, are described below.

(4-5-1) First Internal Space 23a

Figure 6:
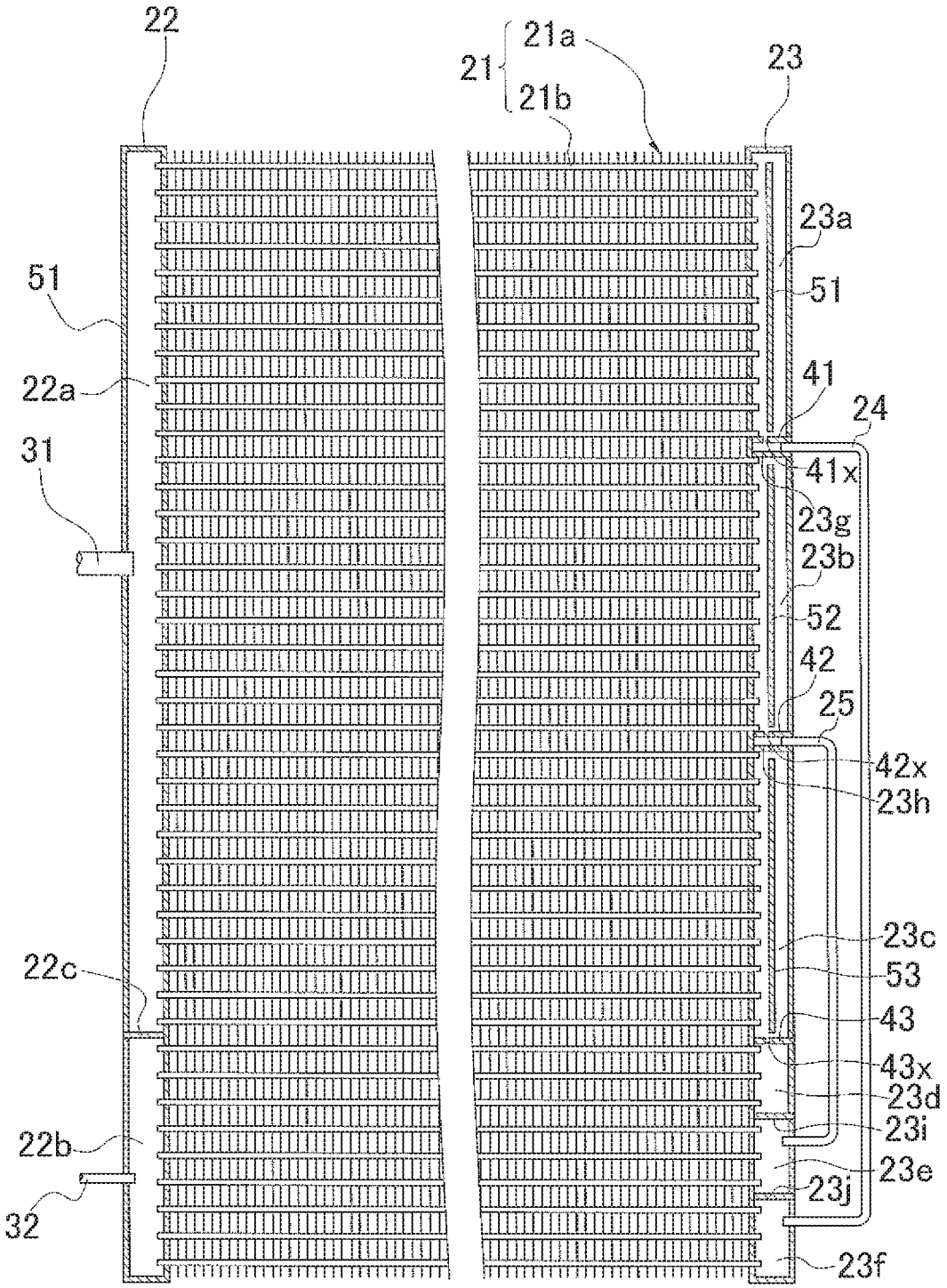
FIG. 6 is a simplified rear view of a configuration of an outdoor heat exchanger.
Figure 9:
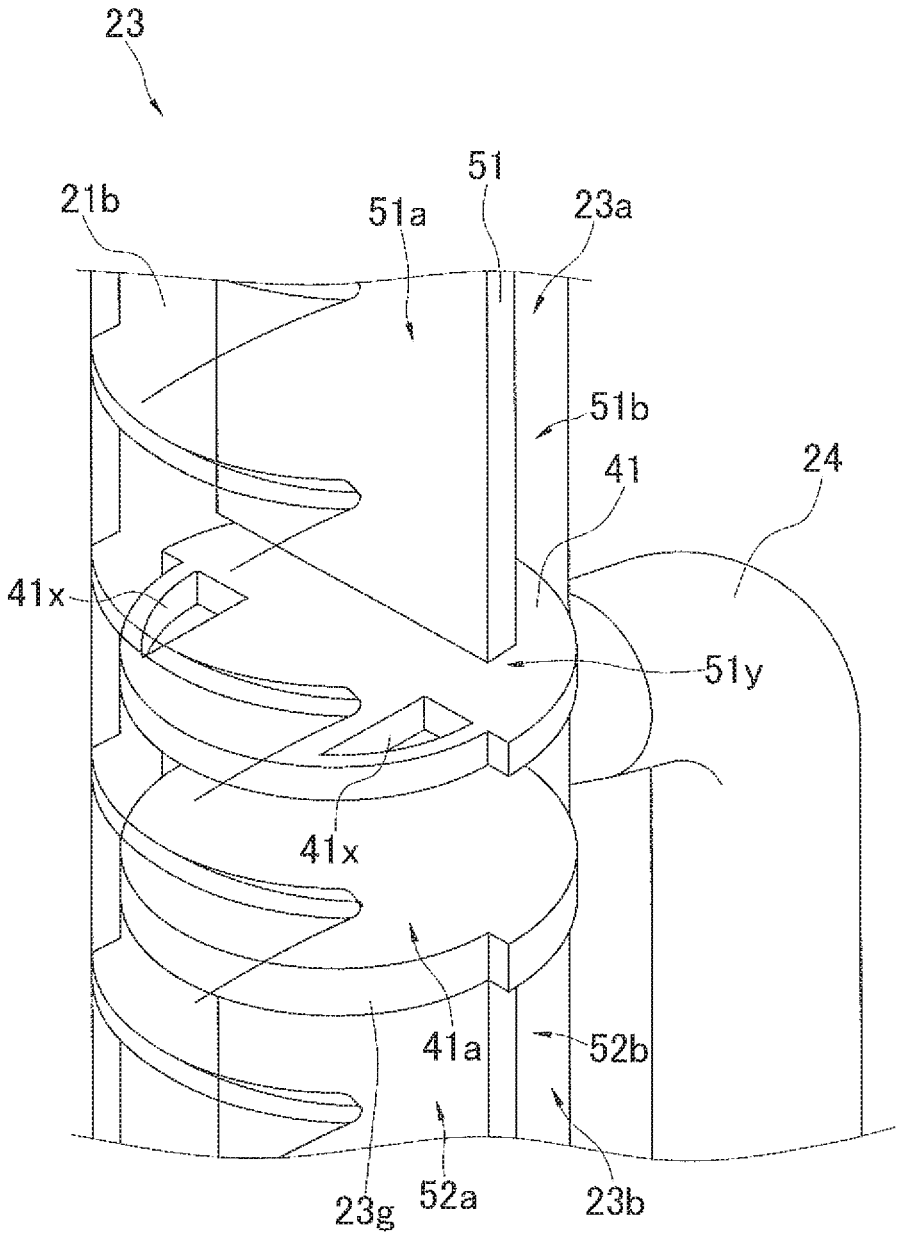
FIG. 9 is a simplified configuration perspective view of a section near the top of a doubled-back header collecting tube.
Figure 10:
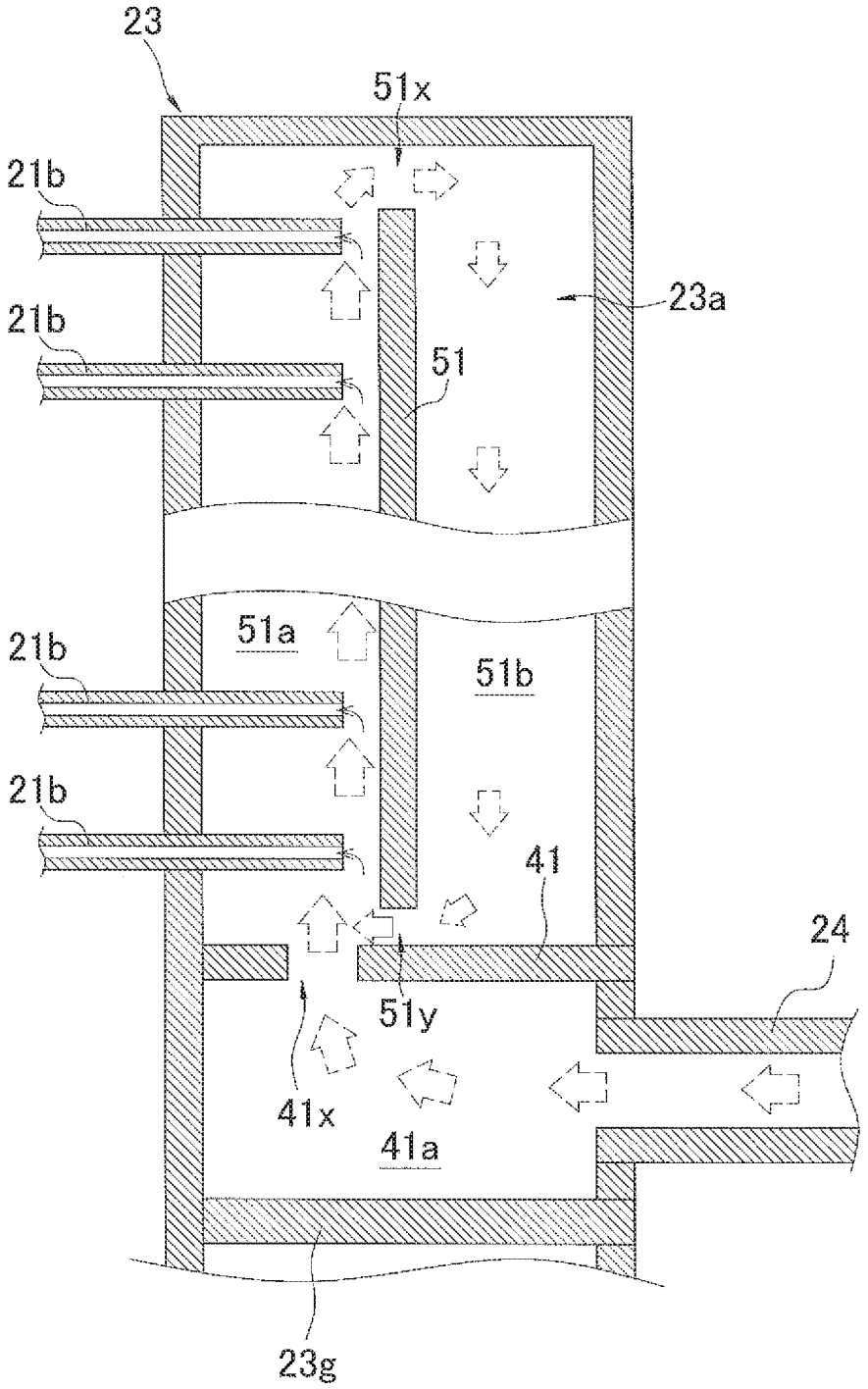
FIG. 10 is a simplified cross sectional view of the vicinity of a first internal space of a doubled-back header collecting tube.
Figure 11:
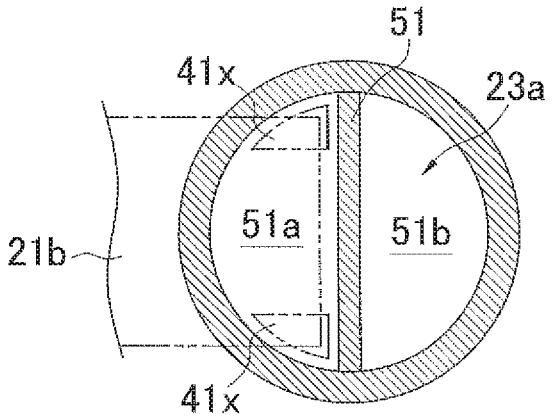
FIG. 11 is a simplified top view of the vicinity of a first internal space of a doubled-back header collecting tube.

As shown in FIG. 6, in a simplified perspective view in FIG. 9, in a simplified cross sectional view in FIG. 10, and in a simplified top view in FIG. 11, respectively, the first internal space 23*a* uppermost in the doubled-back header collecting tube 23 is furnished with a first flow regulation plate 41 and a first partition plate 51.

The first flow regulation plate 41 is a substantially disk-shaped plate member that partitions the first internal space 23*a* into a first flow regulation space 41*a* below, and a first outflow space 51*a* and loop structure 51*b* above. The first flow regulation space 41*a* is a space located above the second baffle 23*g* partitioning the first internal space 23*a* and the second internal space 23*b*, and below the first flow regulation plate 41 disposed at a location lower than the flat perforated tube 21*b* immediately above the second baffle 23*g*. The interconnecting pipeline 24 extending out from the bottommost sixth space 23*f* of the doubled-back header collecting tube 23 communicates with this first flow regulation space 41*a*.

The first partition plate 51 is a generally square plate member that partitions a space above the first flow regulation space 41*a* in the first internal space 23*a* into a first outflow space 51*a* and a first loop space 51*b*. While there are no particular limitations, the first partition plate 51 in the present embodiment is disposed at the center of the first internal space 23*a* to partition the space above the first flow regulation space 41*a* such that the first outflow space 51*a* and the first loop space 51*b* are equal in breadth in top view. The first partition plate 51 is fastened such that side surfaces thereof contact an inner peripheral surface of the doubled-back header collecting tube 23. The first outflow space 51*a* is a space situated on the side at which the flat perforated tubes 21*b* connect at their one ends in the first internal space 23*a*. The first loop space 51*b* is a space situated on the opposite side of the first partition plate 51 from the first outflow space 51*a* in the first internal space 23*a*. The first flow regulation space 41 has a width W1 in a direction perpendicular to the partition plate 51, as shown in FIG. 10. The direction perpendicular to the partition plate 51 is an axial direction of the flat perforated tubes 21*b*. The first outflow space 51*a* has a width W2 in a direction perpendicular to the partition plate 51. The first loop space 51*b* has a width W3 in a direction perpendicular to the partition plate 51. The width W1 of the first flow regulation space 41 includes at least the width W2 of the first outflow space 51*a* and the width W3 of the first loop space 51*b*. The first partition plate 51 has a width W4. The width W1 of the first flow regulation space 41 is at least as wide as a combined width of the first outflow space 51*a* and the first loop space 51*b* (W2+W3). The width W1 of the first flow regulation space 41 is preferably substantially equal to a combined width of the first outflow space 51*a*, the first loop space 51*b*, and the first partition plate 51 (W2+W3+W4).

At the top of the first internal space 23*a* is disposed a first upper communicating passage 51*x* constituted by a vertical gap between the inside of the top end of the doubled-back header collecting tube 23, and a top end section of the first partition plate 51.

At the bottom of the first internal space 23*a* is disposed a first lower communicating passage 51*y* constituted by a vertical gap between the top surface of the first flow regulation plate 41 and a bottom end section of the first partition plate 51. In the present embodiment, the first lower communicating passage 51*y* extends in a horizontal direction from the first loop space 51*b* side towards the first outflow space 51*a*, side. An outlet at the first outflow space 51*a* side of this first lower communicating passage 51*y* is located further below the location of the bottommost of the flat perforated tubes 21*b* connected to the first outflow space 51*a*.

As shown in FIG. 9, the first flow regulation plate 41 is furnished with two first inflow ports 41*x*; these are openings which are disposed in the first outflow space 51*a* constituting the space at the side at which the flat perforated tubes 21*b* extend in the first internal space 23*a*, and which provide communication in the vertical direction. The two inflow ports 41*x* are disposed away to the upstream side and the downstream side in the air flow direction, i.e., the direction of inflow of air with respect to the outdoor heat exchanger 20. The first inflow ports 41*x* are formed so as to be greater in width closer towards the first partition plate 51 side in the direction of air flow, and narrower in width closer towards the flat perforated tube 21*b* side in the direction of air flow. The first inflow ports 41*x* have shapes conforming to the inner peripheral surface of the doubled-back header collecting tube 23.

The first internal space 23*a* has a flow regulation structure in which the refrigerant passage area (the area of a horizontal plane) in the first inflow ports 41*x* is sufficiently smaller than the refrigerant passage area of the first flow regulation space 41*a* (the area of the horizontal plane of the first flow regulation space 41*a*). By adopting this flow regulation structure, the refrigerant flow going from the first flow regulation space 41*a* towards the first outflow space 51*a* side can be sufficiently throttled, and the refrigerant flow velocity upwards in the vertical direction increased.

By partitioning off the space above the first flow regulation plate 41 within the first internal space 23*a* by means of the first partition plate 51, the refrigerant passage area at the first outflow space 51*a* side (the passage area of the ascending refrigerant flow within the first outflow space 51*a*) can be made smaller than the total horizontal area of the first outflow space 51*a* and the first loop space 51*b*. In so doing, it is easy to maintain the ascension velocity of refrigerant inflowing to the first outflow space 51*a* via the first inflow ports 41*x*, making it easy for the refrigerant to reach the upper section of the first outflow space 51*a*, even at a low circulation rate.

As shown in the simplified top view of FIG. 11, the flat perforated tubes 21*b* are embedded within the first outflow space 51*a*, in such a way as to fill in half or more of the horizontal area at heightwise locations in the first outflow space 51*a* where the flat perforated tubes 21*b* are absent. The flat perforated tubes 21*b* and the first inflow ports 41*x* of the first flow regulation plate 41 are arranged at partially overlapping locations in top view.

However, this arrangement is such that when "the horizontal area of sections of flat perforated tubes 21*b* extending into the first outflow space 51*a*" is subtracted from "the horizontal area at heightwise locations within the first outflow space 51*a* where no flat perforated tube 21*b* is present," the remaining area (the area of sections in which the refrigerant navigate around the flat perforated tubes 21*b* and ascend in the first outflow space 51*a*) is greater than the refrigerant passage area of the first lower communicating passage 51*y*. In so doing, it is possible for refrigerant inflowing to the first outflow space 51*a* via the first inflow ports 41*x* to not be passed towards the first loop space 51*b* side through the first lower communicating passage 51*y*, which is narrower and difficult to pass through, but to instead be guided so as to ascend through sections excluding the flat perforated tubes 21*b* in the first outflow space 51*a*, which are wider and easier to pass through.

The first internal space 23*a* has a loop structure that includes the first inflow ports 41*x*, the first partition plate 51, the first upper communicating passage 51*x*, and the first lower communicating passage 51*y*. For this reason, as shown by arrows in FIG. 10, refrigerant that reaches the top in the first outflow space 51*a* without inflowing to the flat perforated tubes 21*b* is guided into the first loop space 51*b* via the first upper communicating passage 51*x* above the first partition plate 51, descends through gravity in the first loop space 51*b*, and returns to the bottom of the first outflow space 51*a* via the first lower communicating passage 51*y* below the first partition plate 51. In so doing, it is possible for the refrigerant reaching the top of the first outflow space 51*a* to be looped around within the first internal space 23*a*.

(4-5-2) Second Internal Space 23*b*

Figure 12:
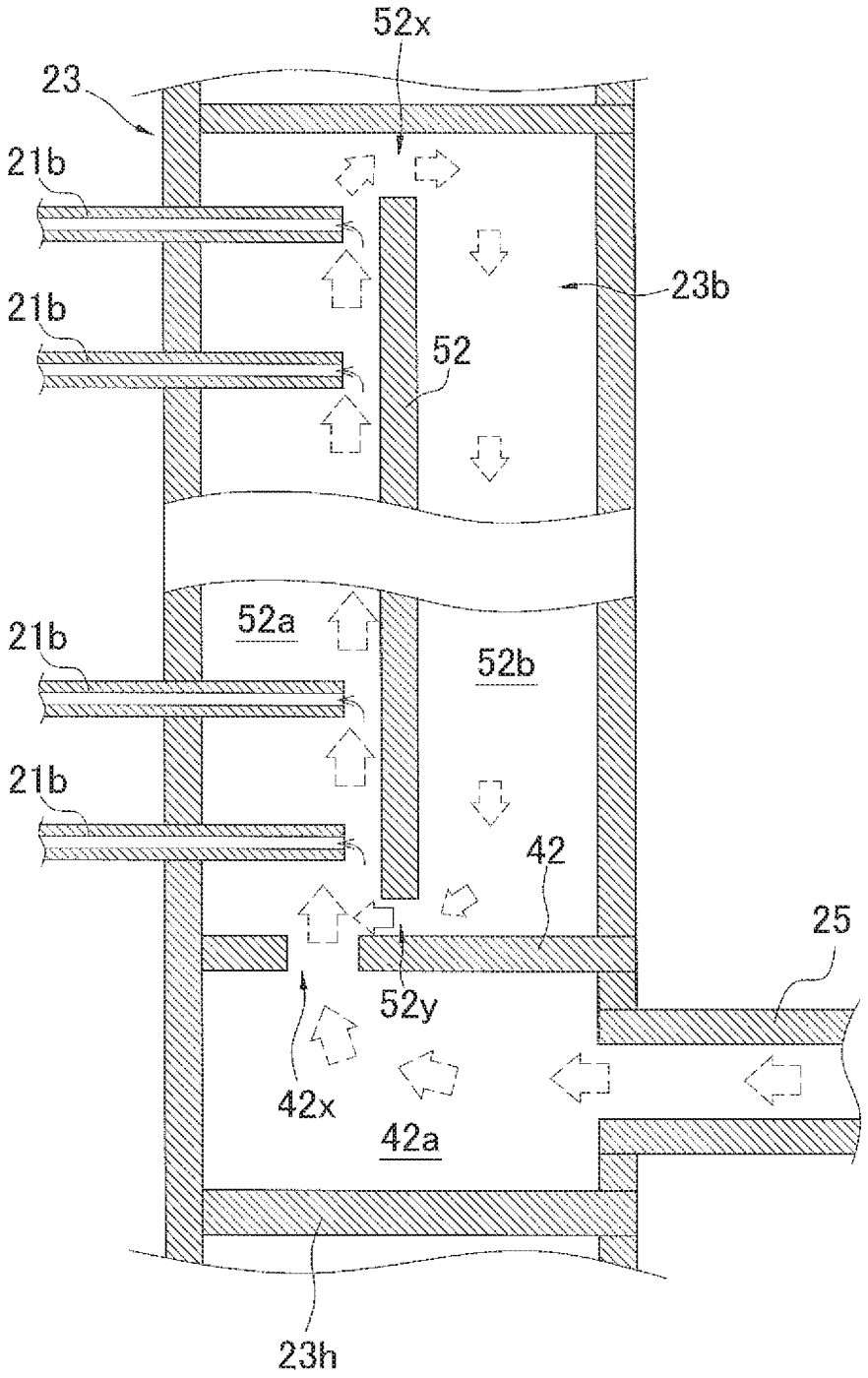
FIG. 12 is a simplified cross sectional view of the vicinity of a second internal space of a doubled-back header collecting tube.

The second internal space 23*b*, which is second from the top of the doubled-back header collecting tube 23, is similar in configuration to the topmost first internal space 23*a*, and as shown in FIG. 6, and in simplified cross sectional view in FIG. 12, respectively, is furnished with a second flow regulation plate 42 and a second partition plate 52.

The second flow regulation plate 42 is a generally disk-shaped plate member that partitions the second internal space 23*b* into a second flow regulation space 42*a* below, and a second outflow space 52*a* and second loop space 52*b* above. The second flow regulation space 42*a* is a space located above the third baffle 23*h* partitioning the second internal space 23*b* and the third internal space 23*c*, and below the second flow regulation plate 42 disposed at a location lower than the flat perforated tube 21*b* immediately above the third baffle 23*h*. The interconnecting pipeline 25 extending out from the fifth space 23*e* second from the bottom in the doubled-back header collecting tube 23 communicates with this second flow regulation space 42*a*.

The second partition plate 52 is a generally square plate member that partitions a space above the second flow regulation plate 42*a* in the second internal space 23*b* into a second outflow space 52*a* and a second loop space 52*b*. The second outflow space 52*a* is a space situated on the side at which the flat perforated tubes 21*b* connect at their one ends, in the second internal space 23*b*. The second loop space 52*b* is a space situated on the opposite side of the second partition plate 52 from the second outflow space 52*a* side in the second internal space 23*b*.

At the top of the second internal space 23*b* is disposed a second upper communicating passage 52*x* constituted by a vertical gap between the bottom surface of the second baffle 23*g* and a top end section of the second partition plate 52.

At the bottom of the first internal space 23*b* is disposed a second lower communicating passage 52*y* constituted by a vertical gap between the top surface of the second flow regulation plate 42 and a bottom end section of the second partition plate 52. In the present embodiment, the second lower communicating passage 52*y* extends in a horizontal direction from the second loop space 52*b* side towards the second outflow space 52*a* side. An outlet at the second outflow space 52*a* side of this second lower communicating passage 52*y* is located further below the location of the bottommost of the flat perforated tubes 21*b* connected to the second outflow space 52*a*.

Like the first flow regulation plate 41, the second flow regulation plate 42 is furnished with two second inflow ports 42*x*, which are vertically communicating openings disposed at the side from which the flat perforated tubes 21*b* extend in the second internal space 23*b*.

Like the first internal space 23*a*, the second internal space 23*b* has a flow regulation structure in which the refrigerant passage area (the area of a horizontal plane) in the second inflow ports 42*x* is sufficiently smaller than the refrigerant passage area of the second flow regulation space 42*a* (the area of the horizontal plane of the first flow regulation space 42*a*).

Further, like the first internal space 23*a*, the second internal space 23*b* has a loop structure that includes the second inflow ports 42*x*, the second partition plate 52, the second upper communicating passage 52*x*, and the second lower communicating passage 52*y*.

The details of the configuration of arrangement are otherwise the same as with the first internal space 23*a*, and accordingly are omitted here.

(4-5-3) Third Internal Space 23*c*

Figure 13:
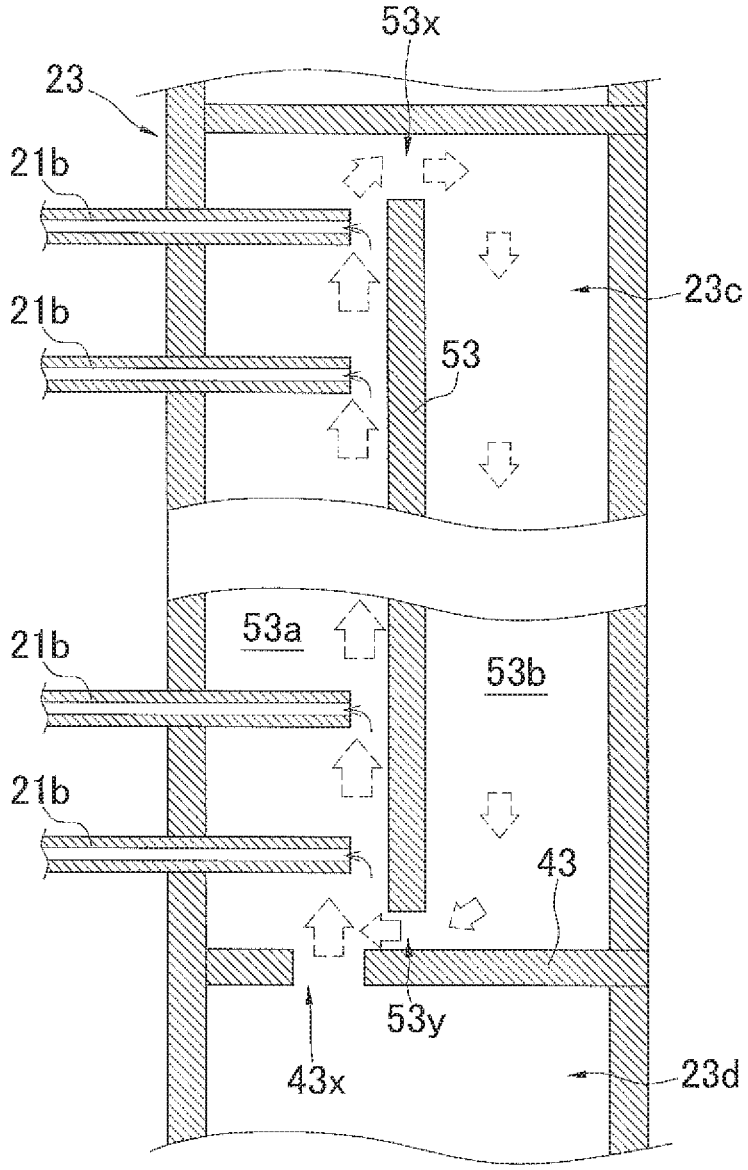
FIG. 13 is a simplified cross sectional view of the vicinity of a third internal space of a doubled-back header collecting tube.

The third internal space 23*c*, which is third from the top of the doubled-back header collecting tube 23, is furnished with a third flow regulation plate 43 and a third partition plate 53, as shown in FIG. 6, and in simplified cross sectional view in FIG. 13, respectively.

The third flow regulation plate 43 is a generally disk-shaped plate member that partitions the third internal space 23*c* into a fourth internal space 23*d* (space located below) that is third from the bottom of the doubled-back header collecting tube 23, and a third outflow space 53*a* and a third loop space 53*b* which are located above.

The third partition plate 53 is a generally square plate member that partitions a space above the fourth internal space 23*d* in the third internal space 23*c* into a third outflow space 53*a* and a third loop space 53*b*. The third outflow space 53*a* is a space situated on the side at which the flat perforated tubes 21*b* connect at their one ends in the third internal space 23*c*. The third loop space 53*b* is a space situated on the opposite side of the third partition plate 53 from the third outflow space 53*a* in the third internal space 23*c*.

At the top of the third internal space 23*c* is disposed a third upper communicating passage 53*x* constituted by a vertical gap between the bottom surface of the third baffle plate 23*h* and a top end section of the third partition plate 53.

At the bottom of the third internal space 23*c* is disposed a third lower communicating passage 53*y* constituted by a vertical gap between the top surface of the third flow regulation plate 43 and a bottom end section of the third partition plate 53. In the present embodiment, the third lower communicating passage 53*y* extends in a horizontal direction from the third loop space 53*b* side towards the third outflow space 53*a* side. An outlet at the third outflow space 53*a* side of this third lower communicating passage 53*y* is located further below the location of the bottommost of the flat perforated tubes 21*b* connected to the third outflow space 53*a*.

Like the first flow regulation plate 41 and the second first flow regulation plate 42, the third flow regulation plate 43 is furnished with two third inflow ports 43*x*, openings which are disposed at the side from which the flat perforated tubes 21*b* extend in the third internal space 23*c*, and which provide communication in the vertical direction.

Like the first internal space 23*a* and the second internal space 23*b*, the third internal space 23*c* has a flow regulation structure in which the refrigerant passage area (the area of a horizontal plane) in the third inflow ports 43*x* is sufficiently smaller than the refrigerant passage area of the fourth internal space 23*d* (the area of the horizontal plane of the fourth internal space 23*d*).

Further, like the first internal space 23*a* and the second internal space 23*b*, the third internal space 23*c* has a loop structure that includes the third inflow ports 43*x*, the third partition plate 53, the third upper communicating passage 53*x*, and the third lower communicating passage 53*y*.

The details of the configuration of arrangement are otherwise the same as with the first internal space 23*a* and the second internal space 23*b*, and accordingly are omitted here.

(5) Overview of Flow of Refrigerant in Outdoor Heat Exchanger 20 During Heating Mode The flow of refrigerant in the outdoor heat exchanger 20 constituted as shown above is described below, mainly in terms of the flow during heating mode.

As shown by an arrow in FIG. 5, during heating mode, refrigerant in a gas-liquid two-phase state is supplied to the lower outlet/inlet internal space 22*b* of the outlet/inlet header collecting tube 22 via the liquid refrigerant pipeline 32, in the description of the present embodiment, the state of the refrigerant inflowing to this lower outlet/inlet internal space 22*b* is assumed to be a gas-liquid two-phase state; however, depending on the outdoor temperature and/or the indoor temperature and/or the operational state, the inflowing refrigerant may be in a substantially single-phase liquid state.

The refrigerant supplied to the lower outlet/inlet internal space 22*b* in the bottom part of the outlet/inlet header collecting tube 22 passes through the plurality of flat perforated tubes 21*b* in the bottom part of the heat exchange part 21 connected to the lower outlet/inlet internal space 22*b*, and is supplied respectively to the three fourth internal spaces 23*d*, 23*e*, 23*f* in the bottom part of the doubled-back header collecting tube 23. As the refrigerant supplied to the three fourth to sixth internal spaces 23*d*, 23*e*, 23*f* in the bottom part of the doubled-back header collecting tube 23 passes through the flat perforated tubes 21*b* in the bottom part of the heat exchange part 21, a portion of the liquid phase component of the refrigerant in the gas-liquid two-phase state evaporates, thereby leading to a state in which the gas phase component is increased.

The refrigerant supplied to the sixth internal space 23*f* at the bottom of the doubled-back header collecting tube 23 passes through the interconnecting pipeline 24, and is supplied to the first internal space 23*a* in the top part of the doubled-hack header collecting tube 23. The refrigerant supplied to the first internal space 23*a* inflows respectively to the plurality of flat perforated tubes 21*b* connected to the first internal space 23*a* (the flow of refrigerant within the first internal space 23*a* will be discussed below). The refrigerant flowing through the plurality of flat perforated tubes 21*b* further evaporates into a gas phase state, and is supplied to the upper outlet/inlet internal space 22*a* at the top of the outlet/inlet header collecting tube 22.

The refrigerant supplied to the fifth internal space 23*e* in the bottom part of the doubled-back header collecting tube 23 passes through the interconnecting pipeline 25 and is supplied to the second internal space 23*b* in the top part of the doubled-back header collecting tube 23. The refrigerant supplied to the second internal space 23*b* inflows respectively to the plurality of flat perforated tubes 21*b* connected to the second internal space 23*b* (the flow of refrigerant within the second internal space 23*b* will be discussed below). The refrigerant flowing through the plurality of flat perforated tubes 21*b* further evaporates into a gas phase state, and is supplied to the upper outlet/inlet internal space 22*a* at the top of the outlet/inlet header collecting tube 22.

The refrigerant supplied to the fourth internal space 23*d* in the bottom part of the doubled-back header collecting tube 23 passes upward on the vertical through the third inflow ports 43*x* furnished to the third flow regulation plate 43, and is supplied to the internal space of the third internal space 23*c* in the top part of the doubled-back header collecting tube 23. The refrigerant supplied to the third internal space 23*c* inflows respectively to the plurality of flat perforated tubes 21*b* connected to the third internal space 23*c* (the flow of refrigerant within the third internal space 23*c* will be discussed below). The refrigerant flowing through the plurality of flat perforated tubes 21*b* further evaporates into a gas phase state, and is supplied to the upper outlet/inlet internal space 22*a* at the top of the outlet/inlet header collecting tube 22.

The refrigerant which has flowed from the first to third internal spaces 23*a*, 23*b*, 23*c* in the top part of the doubled-back header collecting tube 23 through the flat perforated tubes 21*b* and been supplied to the upper outlet/inlet internal space 22*a* at the top of the outlet/inlet header collecting tube 22 converges in the upper outlet/inlet internal space 22*a*, and flows out from the gas refrigerant pipeline 31.

In cooling mode, the refrigerant flow is the reverse of the flow indicated by arrows in FIG. 5.

(6) Flow of Refrigerant in Outdoor Heat Exchanger 20 in a Case of a Low Circulation Rate During Heating Mode The flow of refrigerant in the outdoor heat exchanger 20 in a case of a low circulation rate during heating mode will be described below, taking the example of the first internal space 23*a* of the doubled-back header collecting tube 23.

The refrigerant inflowing to the lower outlet/inlet internal space 22*b* of the outlet/inlet header collecting tube 22 is depressurized in the expansion valve 33, and thereby enters a gas-liquid two-phase state. A portion of the liquid phase component in the refrigerant in the gas-liquid two-phase state that has flowed into to the first internal space 23*a* of the doubled-back header collecting tube 23 evaporates in the course of passage through the flat perforated tubes 21*b* from the lower outlet/inlet internal space 22*b* of the outlet/inlet header collecting tube 22 towards the sixth internal space 23*f* of the doubled-back header collecting tube 23. For this reason, the refrigerant passing through the interconnecting pipeline 24 and flowing into the first internal space 23*a* of the doubled-back header collecting tube 23 is a mixture of a gas phase component and a liquid phase component that differ in specific gravity.

Figure 14:
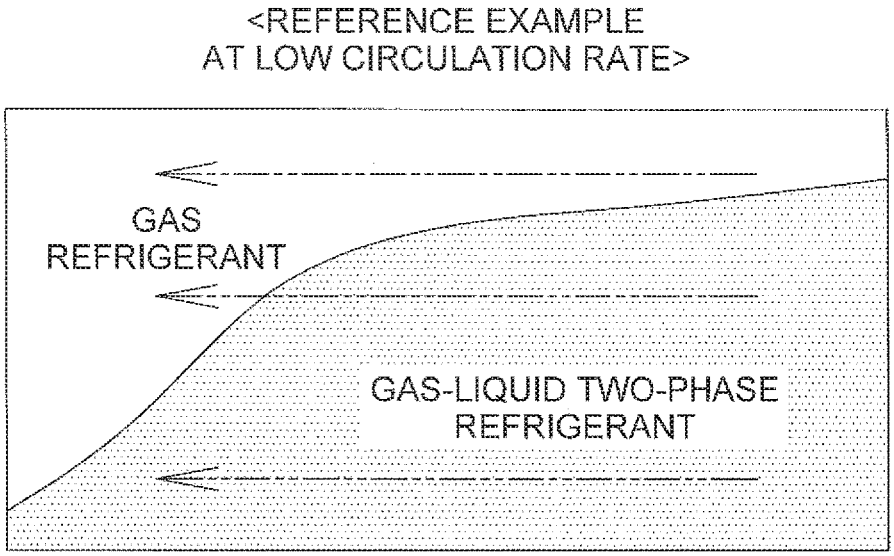
FIG. 14 is a descriptive diagram for reference purposes, showing a condition of refrigerant distribution at a low circulation rate.

In the case of a low circulation rate, the amount of refrigerant inflowing per unit time into the first flow regulation space 41*a* via the interconnecting pipeline 24 is small, and the flow velocity of the refrigerant flowing from the outlet of the interconnecting pipeline 24 is relatively slow. For this reason, as long as this flow velocity remains unchanged, the high-specific gravity liquid phase component in the refrigerant ascends with difficulty, and only with difficulty can reach the tubes at the top among the plurality of flat perforated tubes 21*b* connected to the first internal space 23*a*, which can in some cases lead to uneven rates of passage through the plurality of flat perforated tubes 21*b*, depending on their heightwise locations, and pose a risk of eccentric flow. Accordingly, as shown in the descriptive diagram of FIG. 14 which depicts a reference example during a low circulation rate, when the low-specific gravity gas phase component in the refrigerant flows mainly to the one end side of flat perforated tubes 21*b* that are situated relatively towards the top, the degree of superheat of the refrigerant flowing out from the other end side of these flat perforated tubes 21*b* becomes too great, phase change no longer occurs during passage through the flat perforated tubes 21*b*, and heat exchange capability cannot be sufficiently achieved. Meanwhile, when the high-specific gravity liquid phase component in the refrigerant flows mainly into the one end side of the flat perforated tubes 21*b* that are situated relatively towards the bottom, the refrigerant flowing out from the other end side of these flat perforated tubes 21*b* does not easily reach superheat, and in some instances will reach the other end side of the flat perforated tubes 21*b* without evaporating, so that ultimately heat exchange capability cannot be sufficiently achieved.

In contrast, with the outdoor heat exchanger 20 of the present embodiment, the refrigerant supplied to the first flow regulation space 41*a* experiences an increase in the flow velocity of the vertical upward refrigerant flow as it passes through the first inflow ports 41*x* of the first flow regulation plate 41, which have a throttling function. Moreover, because the space above the first flow regulation plate 41 in the first internal space 23*a* is furnished with the first partition plate 51, the refrigerant passage area of the space on the side where the first inflow ports 41*x* are disposed (the first outflow space 51*a*) is constituted so as to be narrower as compared to the case where the first partition plate 51 is absent, and therefore the ascending flow velocity does not readily decline. For this reason, even in cases of a low circulation rate, the high-specific gravity liquid phase component in the refrigerant can be easily guided to the top within the first outflow space 51*a*.

As the refrigerant inflowing to the first outflow space 51*a* via the first inflow ports 41*x* ascends within the first outflow space 51*a*, the flow is divided among the flat perforated tubes 21*b*, but a small portion of the refrigerant is guided to the top end of the first outflow space 51*a* without flowing into the flat perforated tubes 21*b*.

The refrigerant having reached the top end of the first outflow space 51*a* in this manner is guided into the first loop space 51*b* via the first upper communicating passage 51*x*, and descends in the first loop space 51*b* through gravity. The refrigerant having descended through the first loop space 51*b* flows in a horizontal direction while passing through the first lower communicating passage 51*y* which extends in the horizontal direction, and again returns to the bottom of the first outflow space 51*a*.

The refrigerant that has returned to the first outflow space 51*a* via the lower communicating passage 51*y* is entrained by the ascending flow of the refrigerant passing through the first inflow ports 41*x* and again ascends within the first outflow space 51*a*, and according to circumstances can be made to inflow to the flat perforated tubes 21*b* after being recirculated through the first internal space 23*a*.

Figure 15:
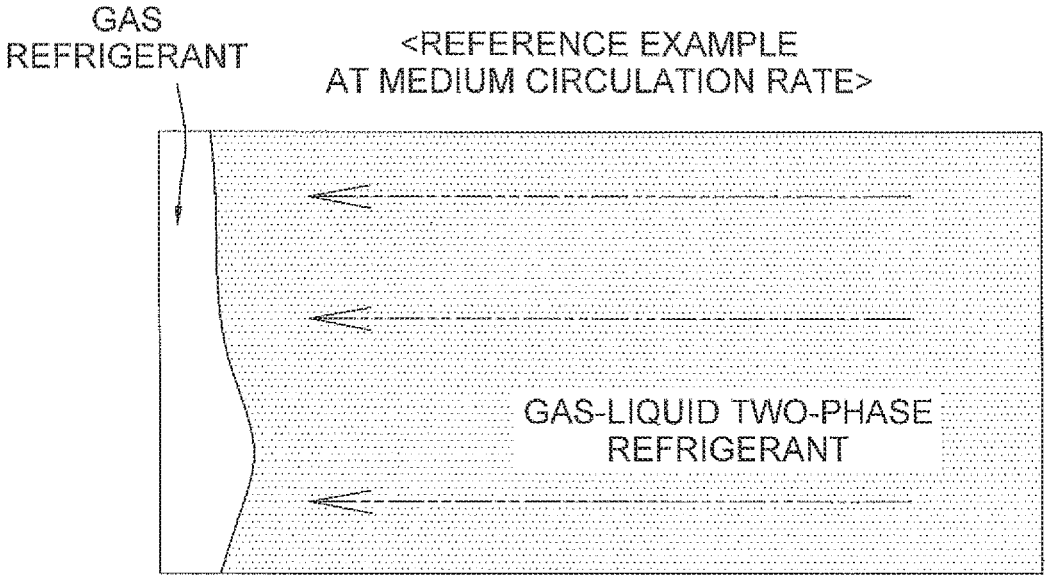
FIG. 15 is a descriptive diagram for reference purposes, showing a condition of refrigerant distribution at a medium circulation rate.

In so doing, in the outdoor heat exchanger 20 of the present embodiment, even at times of a low circulation rate, it is possible for the state of the refrigerant flowing into the plurality of flat perforated tubes 21*b* arranged at sections of different heights to be brought into approximation with the state depicted in the descriptive diagram of FIG. 15, which shows a reference example during a medium circulation rate, and rendered as uniform as possible.

The second internal space 23*b* and the third internal space 23*c* of the doubled-back header collecting tube 23 function in the same way as the first internal space 23*a*, and therefore description is omitted.

(7) Flow of Refrigerant in Outdoor Heat Exchanger 20 in a Case of a High Circulation Rate During Heating Mode The flow of refrigerant in the outdoor heat exchanger 20 in a case of a high circulation rate during heating mode will be described below, taking the example of the first internal space 23*a* of the doubled-back header collecting tube 23.

Here, just as in the case of a low circulation rate, the state of the refrigerant inflowing to the first internal space 23*a* of the doubled-back header collecting tube 23 is one of admixture of a gas phase component and a liquid phase component differing in specific gravity.

Figure 16:
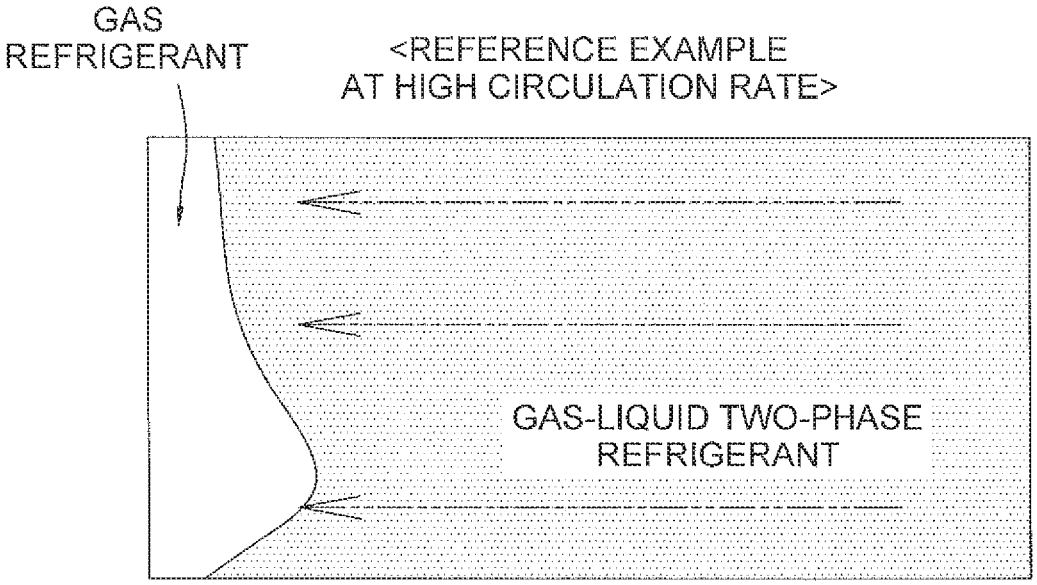
FIG. 16 is a descriptive diagram for reference purposes, showing a condition of refrigerant distribution at a high circulation rate.

In the case of a high circulation rate, the amount of refrigerant inflowing per unit time into the first flow regulation space 41*a* via the interconnecting pipeline 24 is large, and the flow velocity of the refrigerant flowing from the outlet of the interconnecting pipeline 24 is relatively fast. Moreover, the flow velocity is increased even further by the adoption of the throttling function of the first inflow ports 41*x* as the low circulation flow countermeasure discussed previously. Further, due to the narrow refrigerant passage area of the first outflow space 51*a*, the refrigerant passage area of which is constricted by the first partition plate 51 as the low circulation flow countermeasure discussed previously, there is almost no letdown in the ascension velocity of the refrigerant. For this reason, in cases of a high circulation rate, the high-specific gravity liquid phase component of the refrigerant passing forcefully through the first inflow ports 41*x* tends to pass through the first outflow space 51*a* without inflowing to the flat perforated tubes 21*b*, and tends to collect at the top. In such cases, the high-specific gravity liquid phase component tends to collect at the top while low-specific gravity gas phase component tends to collect at the bottom, and ultimately, eccentric flow arises as shown in the descriptive diagram of FIG. 16, showing a reference example during a high circulation rate, although the distribution differs from that at times of a low circulation rate.

In contrast to this, with the outdoor heat exchanger 20 of the present embodiment, due to the adoption of the loop structure in the first internal space 23*a*, the refrigerant reaching the top end of the first outflow space 51*a* is guided into the first loop space 51*b* via the first upper communicating passage 51*x*, and after descending through the first loop space 51*b* is again returned to the first outflow space 51*a* via the first lower communicating passage 51*y*, and thereby can be guided into the flat perforated tubes 21*b* located towards the bottom of the first outflow space 51*a*.

The refrigerant returning to the first outflow space 51*a* via the first lower communicating passage 51*y* is entrained by the ascending flow of refrigerant passing through the first inflow ports 41*x* and again ascends within the first outflow space 51*a*, and according to circumstances can be made to inflow to the flat perforated tubes 21*b* after being recirculated through the first internal space 23*a*.

In so doing, in the outdoor heat exchanger 20 of the present embodiment, even at times of a high circulation rate, it is possible for the state of the refrigerant flowing into the plurality of flat perforated tubes 21*b* arranged at sections of different heights to be brought into approximation with the state depicted in the descriptive diagram of FIG. 15, showing a reference example during a medium circulation rate, and to be rendered as uniform as possible.

The second internal space 23*b* and the third internal space 23*c* of the doubled-hack header collecting tube 23 function in the same way as the first internal space 23*a*, and therefore description is omitted.

(8) Characteristics of Outdoor Heat Exchanger 20 of Air Conditioning Device 1

8-1

With the outdoor heat exchanger 20 of the present embodiment, even in cases of a low circulation rate, the ascent velocity of the refrigerant in the first inner space 23*a* of the doubled-back header collecting tube 23 is maintained by the first inflow ports 41*x* and by the configuration of the first outflow space 51*a* constricted by the first partition plate 51, so that the refrigerant can more easily reach the top of the first outflow space 51*a* (the design of the second internal space 23*b* and the third internal space 23*c* is the same).

Additionally, with the outdoor heat exchanger 20 of the present embodiment, even in cases of a high circulation rate, the refrigerant loops around within the first internal space 23*a* due to the loop structure adopted in the first internal space 23*a* of the doubled-back header collecting tube 23, whereby the refrigerant can be guided into the flat perforated tubes 21*b*.

In the above manner, with the outdoor heat exchanger 20 of the present embodiment, both in cases of a low circulation rate and cases of a high circulation rate, eccentric flow of refrigerant to the plurality of flat perforated tubes 21*b* arranged in the vertical direction can be kept to a minimum.

8-2

In the outdoor heat exchanger 20 of the present embodiment, a loop structure and a flow regulating structure are adopted in the first to third internal spaces 23*a*, 23*b*, 23*c* of the doubled-back header collecting tube 23, but neither in the upper outlet/inlet internal spaces 22*a*, 22*b* of the outlet/inlet header collecting tube 22, nor in the fourth internal spaces 23*d*, 23*e*, 23*f* of the doubled-back header collecting tube 23. Specifically, the loop structure and the flow regulating structure are adopted in the first to third internal spaces 23*a*, 23*b*, 23*c* of the doubled-back header collecting tube 23, in which the refrigerant flowing therethrough in heating mode contains large amounts of admixed gas phase and liquid phase components, resulting in a marked tendency for eccentric flow to arise among the flat perforated tubes 21*b* at different heights.

Therefore, it is possible for the effect of minimizing eccentric flow to be sufficiently realized.

8-3

The refrigerant which has passed through the first inflow ports 41*x* of the outdoor heat exchanger 20 of the present embodiment and just flowed into the first outflow space 51*a* is at maximum ascent velocity, and in some instances tends not to pass through the lower tubes among the plurality of flat perforated tubes 21*b* connected to the first outflow space 51*a*.

In contrast, with the outdoor heat exchanger 20 of the present embodiment, the outlet at the first outflow space 51*a* side of the first lower communicating passage 51*y* is arranged such the refrigerant descending through the first loop space 51*b* in the first internal space 23*a* of the doubled-back header collecting tube 23 can be guided into the flat perforated tubes 21*b* that are connected to the bottom of the first outflow space 51*a*.

For this reason, the flat perforated tubes 21*b* that are located at the bottom, through which the high-flow velocity refrigerant inflowing to the first outflow space 51*a* via the first inflow ports 41*x* tends to pass, can be easily supplied with the refrigerant that has been returned to the first outflow space 51*a* via the first lower communicating passage 51*y*.

The above feature is the same for the second internal spaces 23*b*, 23*c* as well.

(9) Additional Embodiments

The preceding embodiment has been described as but one example of embodiment of the present invention, but is in no way intended to limit the invention of the present application, which is not limited to the aforedescribed embodiment. The scope of the invention of the present application would as a matter of course include appropriate modifications that do not depart from the spirit thereof.

(9-1) Additional Embodiment A

In the aforedescribed embodiment, there was described an example of a case in which the first lower communicating passage 51*y* extends in the horizontal direction from the first loop space 51*b* side towards the first outflow space 51*a* side (the same applies to the second lower communicating passage 52*y* and the third lower communicating passage 53*y* as well).

However, the present invention is not limited to this arrangement; another acceptable configuration would be one in which, for example, the first lower communicating passage 51*y*, rather than extending in the horizontal direction as in the aforedescribed embodiment, is instead inclined so as be located further towards the bottom going from the first loop space 51*b* side towards the first outflow space side 51*a*, or is inclined so as be located further towards the top going from the first loop space 51*b* side towards the first outflow space side 51*a*. As the extent of this incline, an incline of 60 degrees or less with respect to the horizontal direction would be acceptable, as would one of 30 degrees or less; and an incline of −60 degrees or more with respect to the horizontal direction would be acceptable, as would one of −30 degrees or more, for example. In particular, from the standpoint of not hindering upward flow of the refrigerant in the first outflow space 51*a*, the extent of the incline is preferably from 0 to 60 degrees, and more preferably 0 to 30 degrees, with respect to the horizontal direction.

With this configuration as well, it is possible for the refrigerant circulated through the first internal space 23*a* to be again guided into the flat perforated tubes 21*b*.

The above feature could be implemented analogously in the second lower communicating passage 52*y* and the third lower communicating passage 53*y* as well.

(9-2) Additional Embodiment B

In the aforedescribed embodiment, there was described an example of a case in which the first flow regulation plate 41, a plate-shaped member, is furnished with the first inflow ports 41*x* that open in the thickness direction as do the second inflow ports 42*x* and the third inflow ports 43*x*).

However, the present invention is not limited to this arrangement, and, for example, a cylindrical inflow passage extending in the vertical direction could be furnished in place of inflow ports formed by openings in a plate-shaped member. In this case, it will be possible to further boost the velocity of the refrigerant outflowing vertically upward as the refrigerant passes through the cylindrical inflow passage.

The above feature could be implemented analogously in the second inflow ports 42*x* and the third inflow ports 43*x* as well.

(9-3) Additional Embodiment C

In the aforedescribed embodiment, there was described an example of a case in which the first inflow ports 41*x* are arranged at locations partially overlapping the flat perforated tubes 21*b* in top view (as are the second inflow ports 42*x* and the third inflow ports 43*x*).

However, the present invention is not limited to this arrangement, and the locations of the first inflow ports 41*x* in top view are arbitrary, provided that the locations are at the first outflow space 51*a* side, for example.

The above feature could be implemented analogously in the second inflow ports 42*x* and the third inflow ports 43*x* as well.

(9-4) Additional Embodiment D

In the aforedescribed embodiment, there was described an example of a case in which the outlet of the first lower communicating passage 51*y* at the first outflow space 51*a* side is located further below the location of the bottommost of the plurality of flat perforated tubes 21*b* connected to the first outflow space 51*a* (as are the outlets of the second lower communicating passage 52*y* and the third lower communicating passage 53*y*).

However, the present invention is not limited to this arrangement; it would be acceptable for the outlet of the first lower communicating passage 51*y* at the first outflow space 51*a* side to be situated in proximity to the location of the bottommost of the plurality of flat perforated tubes 21*b* connected to the first outflow space 51*a*, for example, at the same height at the bottommost one.

The above feature could be implemented analogously in the second lower communicating passage 52*y* and the third lower communicating passage 53*y* as well.

(9-5) Additional Embodiment E

In the aforedescribed embodiment and additional embodiments, there were described examples of cases in which the space above the first flow regulation plate 41 of the first internal space 23*a*, the space above the second flow regulation plate 42 of the second internal space 23*b* and, and the space above the third flow regulation plate 43 in the third internal space 23*c* are similar in form.

However, the present invention is not limited to this arrangement; it would be acceptable for the forms to differ from one another.

(9-6) Additional Embodiment F

In the aforedescribed embodiment, there was described an example in which the doubled-back header collecting tube 23 has the first lower communicating passage 51*y* which constituted by the lower end section of the first partition plate 51 and the top surface section of the first flow regulation plate 41 (the second lower communicating passage 52*y* and the third lower communicating passage 53*y* are similarly constituted).

Figure 17:
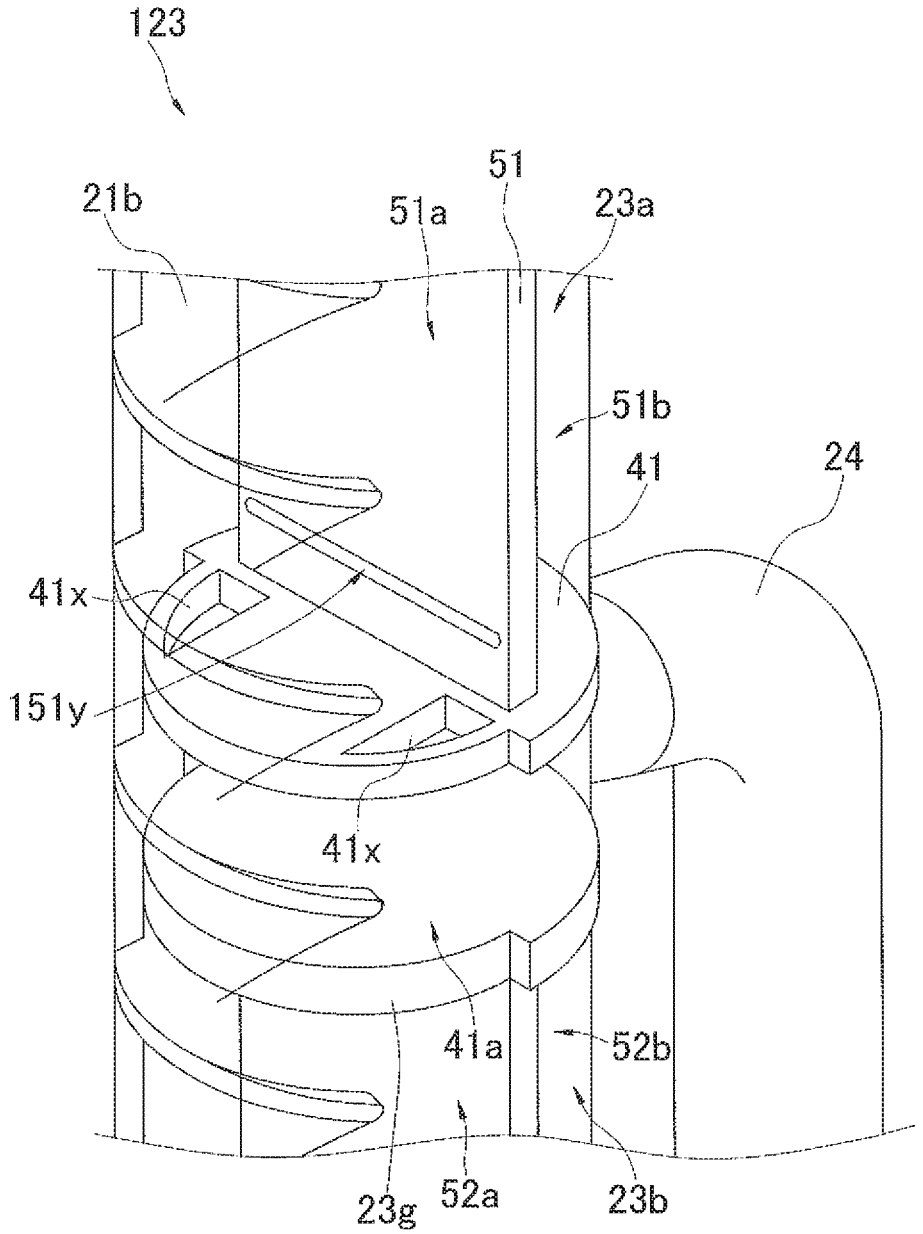
FIG. 17 is a simplified configuration perspective view of a section near the top of a doubled-back header collecting tube according to another embodiment F.

However, the present invention is not limited to this arrangement; it would be acceptable to adopt, for example, a doubled-back header collecting tube 123 like that shown in FIG. 17, in place of the doubled-back header collecting tube 23 of the aforedescribed embodiment.

The doubled-back header collecting tube 123 is furnished with a first lower communicating passage 151*y* perforating the bottom of a first partition plate 151 in the thickness direction so as to connect the first outflow space 51*a* and the first loop space 51*b*. The entirety of the lower end section of the first partition plate 151 is supported through contact with the top surface of the first flow regulation plate 41.

In this case, there is no need to adjust the height position of the first partition plate 51 in order to adjust the refrigerant passage area of the first lower communicating passage 51*y* as in the aforedescribed embodiment, and the first lower communicating passage 151*y* of the first partition plate 151 may be designed beforehand to have the desired refrigerant passage area, whereby manufacture can be simplified.

(9-7) Additional Embodiment G

Figure 18:
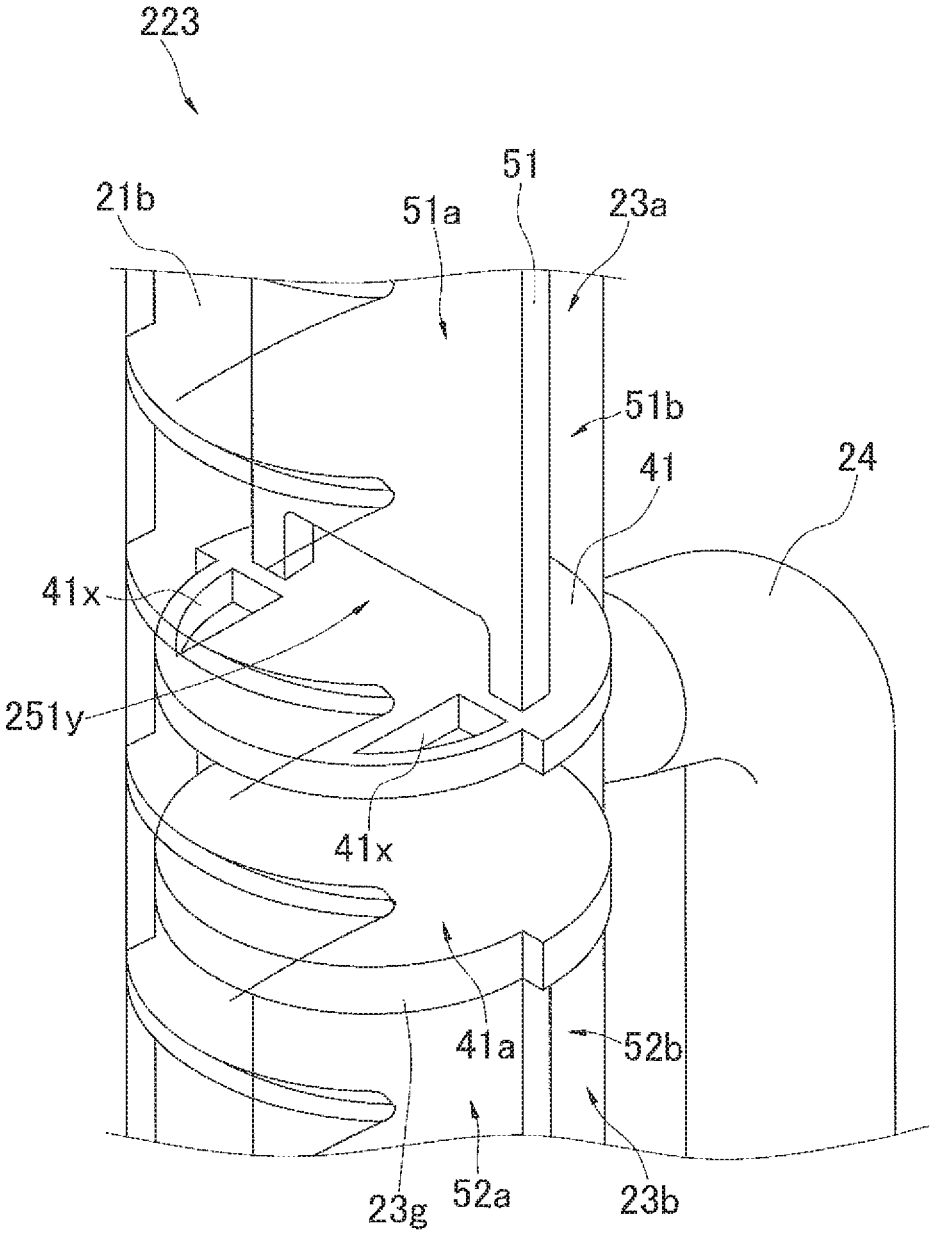
FIG. 18 is a simplified configuration perspective view of a section near the top of a doubled-back header collecting tube according to another embodiment G.

It would be acceptable to adopt, for example, a doubled-back header collecting tube 223 like that shown in FIG. 18, in place of the doubled-back header collecting tube 23 of the aforedescribed embodiment.

The doubled-back header collecting tube 223 is constituted such that a portion of a lower end section of a first partition plate 251 is depressed upwardly. For this reason, with the first partition plate 251 positioned on the top surface of the first flow regulation plate 41, it is possible for a first lower communicating passage 251*y* to be constituted by the top surface (flat surface) of the first flow regulation plate 41 and the upwardly depressed section of the lower end section of the first partition plate 251.

In this case, there is no need to adjust the height position of the first partition plate 51 in order to adjust the refrigerant passage area of the first lower communicating passage 51*y* as in the aforedescribed embodiment, and the size of the depressed section of the lower end section of the second partition plate 251 may be designed beforehand to have the desired refrigerant passage area, whereby manufacture can be simplified. Moreover, it is possible for the second partition plate 251 to be supported by the non-depressed sections of the lower end section thereof arranged so as to contact the top surface of the first flow regulation plate 41.

(9-8) Additional Embodiment H

In the aforedescribed embodiment, there was described an example of a case in which flat plate members like the heat transfer fins 21*a* shown in FIGS. 7 and 8 are employed as heat transfer fins.

However, the present invention is not limited to this arrangement, and application, for example, to a heat exchanger employing corrugated type heat transfer fins, such as those employed primarily in automotive heat exchangers, would also be possible.

What is claimed is:

1. A heat exchanger comprising:

a plurality of flat tubes arranged in a mutually spaced arrangement;

a first header collecting tube connected to first ends of the flat tubes, the first header collecting tube extending in a vertical direction;

a second header collecting tube connected to second ends of the flat tubes, the second header collecting tube extending in the vertical direction; and a plurality of fins joined to the flat tubes, at least one of the first header collecting tube and the second header collecting tube having a loop structure including a partition member partitioning a single internal space into a single first space where the flat tubes are connected, and a single second space disposed to a side opposite from where the flat tubes are connected to the first space, an inflow port located in a lower part of the first space, the inflow port prompting inflow of refrigerant so as to give rise to an ascending flow within the first space when the heat exchanger functions as a refrigerant evaporator, an upper communicating passage located in upper parts of the first space and the second space, the upper communicating passage providing communication between the upper parts of the first space and the second space in order to guide the refrigerant that has ascended within the first space into the second space, a lower communicating passage located in the lower parts of the first space and the second space, the lower communicating passage providing communication between the lower parts of the first space and the second space, guiding the refrigerant in a direction other than the vertical direction from the second space towards a space above the inflow port in the first space in order to guide the refrigerant from the first space to the second space, and returning the refrigerant having descended through the second space from the second space to the first space, and a flow regulation space formed at bottoms of the first space and the second space of the internal space, a width of the flow regulation space including at least a width of the first space and a width of the second space, the widths of the flow regulation space, the first space and the second space being in a direction perpendicular to the partition member, the inflow port, the upper communicating passage and the lower communicating passage being disposed in the single internal space, and the flat tubes including bottommost flat tubes disposed at bottommost locations of the flat tubes located above the inflow port, a top portion of the lower communicating passage being disposed above a top portion of the inflow port, and the lower communicating passage being disposed adjacent the bottommost flat tubes above the inflow port.

2. The beat exchanger according to claim 1, wherein the first and second spaces and the flow regulation space are partitioned by a flow regulation member, and the inflow port is formed in the flow regulation member such that a passage cross section area of the refrigerant going from the flow regulation space towards the first space can be throttled.

3. The beat exchanger according to claim 2, wherein the lower communicating passage is formed by a lower section of the partition member and an upper section of the flow regulation member.

4. The heat exchanger according to claim 1, wherein the loop structure is arranged at locations such that, when the heat exchanger functions as a refrigerant evaporator, the refrigerant may flow in a distributed fashion to another portion of the plurality of flat tubes after having passed through a portion of the plurality of flat tubes.

5. An air conditioning device including the heat exchanger according to claim 1, the air conditioning device further comprising a variable-capacity compressor connected to the heat exchanger to form a refrigerant circuit.

6. The heat exchanger according to claim 2, wherein the loop structure is arranged at locations such that, when the heat exchanger functions as a refrigerant evaporator, the refrigerant may flow in a distributed fashion to another portion of the plurality of flat tubes after having passed through a portion of the plurality of flat tubes.

7. An air conditioning device including the heat exchanger according to claim 2, the air conditioning device further comprising a variable-capacity compressor connected to the heat exchanger to form a refrigerant circuit.

8. An air conditioning device including the heat exchanger according to claim 4, the air conditioning device further comprising a variable-capacity compressor connected to the heat exchanger to form a refrigerant circuit.

9. A heat exchanger comprising:

a plurality of flat tubes arranged in a mutually spaced arrangement;

a doubled-back header collecting tube connected to first ends of the flat tubes, the doubled-back header collecting tube extending in a vertical direction;

a facing header collecting tube connected to second ends of the flat tubes, the facing header collecting extending in the vertical direction; and a plurality of fins joined to the flat tubes, the doubled-back header collecting tube having a loop structure including a partition member partitioning a single internal space into a single first space where the flat tubes are connected, and a single second space disposed to a side opposite from where the flat tubes are connected to the first space, an inflow port located in a lower part of the first space, the inflow port prompting inflow of refrigerant so as to give rise to an ascending flow within the first space when the heat exchanger functions as a refrigerant evaporator, an upper communicating passage located in upper parts of the first space and the second space, the upper communicating passage providing communication between the upper parts of the first space and the second space in order to guide the refrigerant that has ascended within the first space into the second space, and a lower communicating passage located in lower part of the first space and the second space, the lower communicating passage providing communication between the lower parts of the first space and the second space, guiding the refrigerant in a direction other than the vertical direction from the second space towards space above the inflow port in the first space in order to guide the refrigerant from the first space to the second space, and returning the refrigerant having descended through the second space from the second space to the first space, the doubled-back header collecting tube doubling back the refrigerant flow, the facing header collecting tube being arranged facing the doubled-back header collecting tube, the plurality of flat tubes being grouped into an upper-side heat exchange area formed by one or more upper-side heat exchange parts vertically arrayed, and a lower-side heat exchange area located below the upper-side heat exchange area and formed by one or more lower-side heat exchange parts positioned vertically, a facing lower-side internal space being formed at a lower-side of an interior of the facing header collecting tube, and the facing lower-side internal space corresponds to the one or more lower-side heat exchange parts, an interior of the doubled-back header collecting tube being partitioned vertically into doubled-back upper-side internal spaces corresponding in number to a number of the upper-side heat exchange parts, and doubled-back lower-side internal spaces corresponding in number to a number of the lower-side heat exchange parts, and the doubled-back upper-side internal spaces and the doubled-back lower-side internal spaces communicating with one another, the loop structure being arranged in the doubled-back upper-side internal spaces and above the doubled-back lower-side internal spaces, the inflow port, the upper communicating passage and the lower communicating passage being disposed in the single internal space, and the flat tubes including bottommost flat tubes disposed at bottommost locations of the flat tubes located above the inflow port, a top portion of the lower communicating passage being disposed above a top portion of the inflow port, and the lower communicating passage being disposed adjacent the bottommost flat tubes above the inflow port.

* * * * *